US009985397B2

(12) United States Patent
Jiang

(10) Patent No.: US 9,985,397 B2
(45) Date of Patent: May 29, 2018

(54) PLUG-IN POWER SUPPLY WITH INTERCHANGEABLE MAINS PLUG UNITS

(71) Applicant: FRIWO Gerätebau GmbH, Ostbevern (DE)

(72) Inventor: Weihua Jiang, Guangdong (CN)

(73) Assignee: FRIWO Gerätebau GmbH, Ostbevern (DE)

( * ) Notice: Subject to any disclaimer, the term of this patent is extended or adjusted under 35 U.S.C. 154(b) by 0 days. days.

(21) Appl. No.: 15/506,468

(22) PCT Filed: Aug. 25, 2014

(86) PCT No.: PCT/CN2014/085122
§ 371 (c)(1),
(2) Date: Feb. 24, 2017

(87) PCT Pub. No.: WO2016/029347
PCT Pub. Date: Mar. 3, 2016

(65) Prior Publication Data

US 2017/0244206 A1 Aug. 24, 2017

(51) Int. Cl.
*H01R 29/00* (2006.01)
*H01R 27/00* (2006.01)
(Continued)

(52) U.S. Cl.
CPC ..... *H01R 27/00* (2013.01); *H01R 13/5219* (2013.01); *H01R 13/6675* (2013.01); *H01R 31/06* (2013.01)

(58) Field of Classification Search
CPC ..... H01R 27/00
(Continued)

(56) References Cited

U.S. PATENT DOCUMENTS 4,973,827 A * 11/1990 Nozaki ..... A61L 12/04 219/386
5,634,806 A 6/1997 Hahn
(Continued)

FOREIGN PATENT DOCUMENTS

CN 101019283 8/2007
CN 201075441 6/2008
(Continued)

OTHER PUBLICATIONS

International Search Report and Written Opinion for Application No. PCT/CN2014/085122 dated Dec. 31, 2014 (10 pages).
(Continued)

*Primary Examiner* — Neil Abrams
(74) *Attorney, Agent, or Firm* — Michael Best & Friedrich LLP

(57) ABSTRACT

A plug-in power supply for supplying a consumer with a low voltage and a plug-in power supply which in operation is configured as a power adapter unit with one of its matching interchangeable mains plug units. The power adapter unit comprises a housing; a voltage transformer module for converting a mains voltage into the required low voltage in the housing; an engaging seat, for the plug unit, at an inner side of the power adapter unit to be directed towards a mains socket, the plug unit being slidably connected with the engaging seat; at least two electric contacts in the seat connecting the transformer module with contacts at an inner side of the plug unit directed towards the power adapter unit; and a locking member, at a rear profile of the engaging seat which limits the sliding of the plug unit. The plug unit comprises at least two mains plug pins, extending from an outer side of the plug unit and connected to the contacts at the inner side of the plug unit; safety recesses, for said contacts at the inner side of the plug unit; and a locking structure, comprising a button, for interacting with the
(Continued)

locking member so that pressing on the button releases the structure and allows sliding of the plug unit from the engaging seat.

23 Claims, 27 Drawing Sheets

(51) Int. Cl.
*H01R 31/06* (2006.01)
*H01R 13/52* (2006.01)
*H01R 13/66* (2006.01)

(58) Field of Classification Search
USPC ..... 439/172, 173, 518
See application file for complete search history.

(56) References Cited

U.S. PATENT DOCUMENTS 5,648,712 A * 7/1997 Hahn ..... H01R 27/00 320/111
5,684,689 A * 11/1997 Hahn ..... H01R 13/6675 363/146
5,744,934 A * 4/1998 Wu ..... H01R 13/6675 307/150
5,848,907 A * 12/1998 Chen ..... H01R 27/00 439/172
6,109,977 A * 8/2000 Baxter ..... H01R 13/04 439/171
6,227,888 B1 * 5/2001 Hahn ..... H01R 27/00 439/172
6,893,297 B2 * 5/2005 Chen ..... H01R 31/06 439/680
6,988,903 B1 * 1/2006 Cheng ..... H01R 31/065 439/137
7,008,246 B2 * 3/2006 Zhuge ..... H01R 13/6272 439/131
7,300,297 B1 * 11/2007 Wang ..... H01R 13/2442 439/173
7,547,219 B2 * 6/2009 Zhuge ..... H01R 13/4534 439/173
7,654,838 B1 * 2/2010 Zhuge ..... H01R 13/652 439/173
7,769,413 B2 * 8/2010 Simoes ..... H01R 31/06 320/112
8,087,946 B2 * 1/2012 Namiki ..... H01R 13/639 439/170
8,215,974 B2 * 7/2012 Lau ..... H01R 13/514 439/172
8,251,718 B2 * 8/2012 Chen ..... H01R 31/06 439/131
8,936,490 B2 * 1/2015 Hsu ..... H01R 35/04 439/103
8,944,845 B2 * 2/2015 Yu ..... H01R 13/447 439/171
9,455,542 B2 * 9/2016 Gaither ..... H01R 31/06
9,543,704 B1 * 1/2017 Hsu ..... H01R 13/645
9,722,377 B1 * 8/2017 Cheng ..... H01R 31/06
2003/0017728 A1 1/2003 Ogawa
2009/0117765 A1 5/2009 Wen et al.
2010/0062652 A1 * 3/2010 Liu ..... H01R 31/06 439/660
2017/0244206 A1 * 8/2017 Jiang ..... H01R 27/00

FOREIGN PATENT DOCUMENTS

| | | |
|---|---|---|
| CN | 201319463 | 9/2009 |
| CN | 201478652 | 5/2010 |
| CN | 202308685 | 7/2012 |
| DE | 202006010787 | 10/2006 |
| EP | 1562270 | 8/2005 |
| JP | 2006034066 | 2/2006 |
| JP | 2011159397 | 8/2011 |
| JP | 2012043667 | 3/2012 |
| WO | 2016/029347 | 3/2016 |

OTHER PUBLICATIONS

European Patent Office Search Report for Application No. 14900483.0 dated Feb. 26, 2018, 8 pages.
Japanese Patent Office Action for Application No. 2017-511163 dated Mar. 20, 2018, with English translation, 14 pages.

* cited by examiner

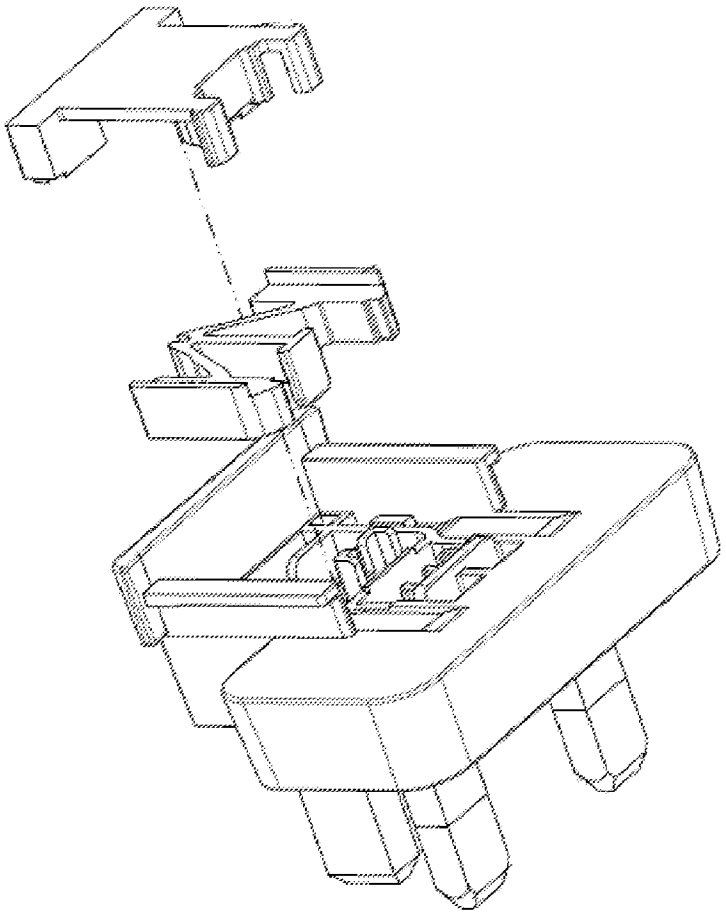
Fig. 10D
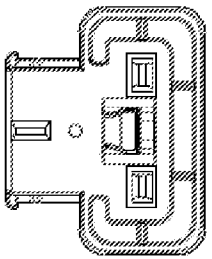
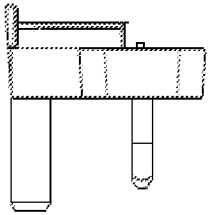
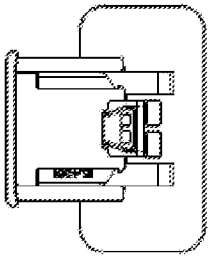

PLUG-IN POWER SUPPLY WITH INTERCHANGEABLE MAINS PLUG UNITS

FIELD OF THE INVENTION

The present invention relates to a plug-in power supply for supplying a consumer with a low voltage, and in particular to a plug-in power supply which in operation is configured as a power adapter unit with one of its matching interchangeable mains plug units.

DESCRIPTION OF THE RELATED ART

Plug-in power supplies in the lowest power range are often made, as far as their electronic concept is concerned, with the capability to operate with various mains power profiles, which differ, for example, in voltage amplitude and frequency between different regions in the world. Such switching mode power supplies are used in many fields of application, for example, in cell phone or tablet pc industries. Thus, a plug-in power supply can provide to an electric appliance a so-called universal input voltage input. However, there are, as well, great differences between the electric sockets and plug requirements in different regions of the world.

Consequently, plug-in power supplies are often used with so-called plug adapters. A plug adapter has one or more plug shaped for use with mains power socket of one or more type. Also, it has one or more socket shaped for use with one or more mains power plug of one or more type. The adapter's one or more plug and socket are interconnected, so that when the plug adapter is plugged in, for example, into a European mains power socket, a user can plug in his device with a US plug into the adapter's socket. However, the plug adapters typically detriment the safety of the electric chain, due to the enlarged distance between the plug-in power supply and the mains power socket, which increases the torque acting on the power socket. In many cases, the plug adapter has only one socket, shaped for use with power plugs of several types, i.e. the plug adapter socket has some features of different mains power sockets. This also reduces the safety of the plug adapters, since an accidental contact with the powered pins becomes more probable when pins of a plug are inserted into the plug adapter socket and gaps are left.

Hence, in some cases plug-in power supply is designed to be provided with interchangeable mains plug units, the one of which, matching with the local mains socket, will be used in operation. The mains plug unit of the plug-in power supply differs from the plug adapter in that it is not configured to provide a mains socket to the next member in the electric chain, i.e. the power adapter unit of the plug-in power supply. Also, the power adapter unit constitutes only a part of the plug-in power supply because it typically does not have a plug for a mains socket.

An example of a plug-in power supply with the interchangeable, or synonymously, exchangeable, mains plug units is disclosed in U.S. Pat. No. 7,563,115.

An ordinarily skilled person would know that a cell phone package may be prepared with a new power supply. The package may include, for example, a cell phone as in the art, in particular as on the market, and the plug-in power supply adapted to provide a low voltage required for charging the cell phone.

Similarly, the skilled person would know that a new tablet PC package, or a new laptop package may be prepared.

DETAILED DESCRIPTION OF THE INVENTION

According to the idea of the inventor, it is desirable to improve the balance between different parameters characterizing power supply with interchangeable detachable mains plug units, with respect to various prior art designs. In particular, such improvement in balance may be achieved by configuring the power supply for convenient usage with one hand only. The design of the device is to allow inexpensive production.

Hence, the handling of the device in its entirety is substantially simplified as far as an exchange of plug units is concerned, and the overall design can be implemented such that a better process reliability will be achieved.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Similar or corresponding details of the plug-in power supply according to the present invention are provided with identical reference numerals. Further features and advantages will become apparent from the following and more particular description of the invention is illustrated in the accompanying drawings, wherein:

Also, FIGS. 7A, 7B, 7C, 8, 9, 10A, 10B, 10C, 10D, 11, 12, 13, 14, 15A, 15B, 15C, 15D, 16A, 16B, 16C, and 16D are included.

DETAILED DESCRIPTION BASED ON THE DRAWINGS

The illustrated embodiments of the present invention will be described with reference to the figure drawings wherein like elements and structures are indicated by like reference numbers.

Figure 1:
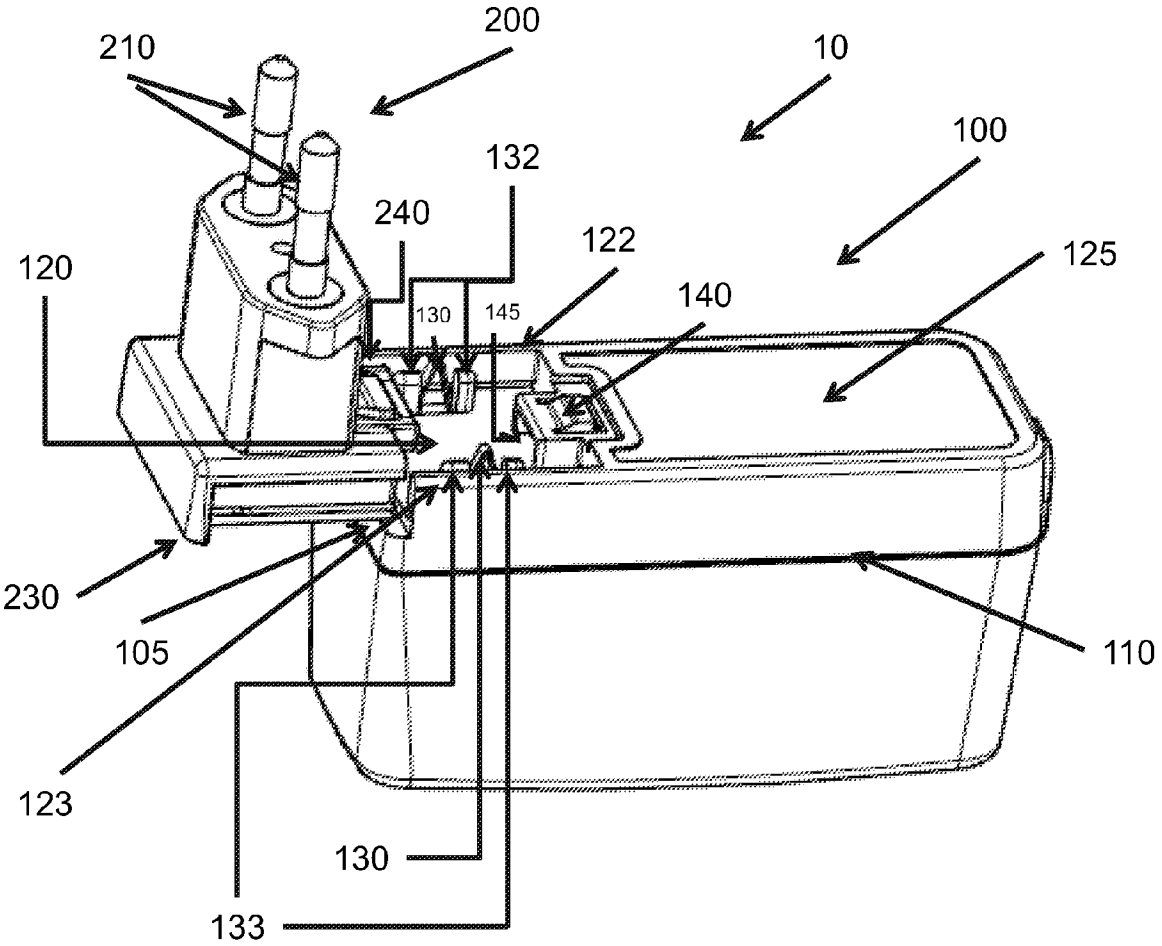
FIG. 1 shows a perspective view of a plug-in power supply, ready to be assembled, with a plug unit being in a position to engage with a power adapter unit, according to some embodiments of the present invention.

Referring to FIG. 1, it shows a perspective view of a plug-in power supply 10, ready to be assembled, with a plug unit 200 being in a position to engage with a power adapter unit 100. FIG. 1 shows a preferred embodiment, and not all parts shown in FIG. 1 are necessary to make the invention.

The power adapter unit 100 includes a housing 110; an engaging seat 120, for the plug unit, at an inner side 125 of the power adapter unit to be directed towards a mains socket;

two electric contacts 130 in the seat 120; and a locking member 140, at a rear profile 145 of the engaging seat. Furthermore, the housing 110 includes a voltage transformer module, which is however not shown in this figure, for converting a mains voltage into the required low voltage in the housing. The number of electric contacts may be more than two in different embodiments. In particular, it may be three. The electric contacts 130 connect the transformer module with contacts at an inner side of the plug unit 200. These electric contacts 130 may be spring contacts. This inner side of the plug unit 200, directed towards the power adapter unit, is shown, for example, in FIG. 4.

In FIG. 1, the plug unit 200 is prepared to be slidably connected with the engaging seat 120. The rear profile 145 of the engaging seat will limit the sliding of the plug unit.

Further, in FIG. 1, the plug unit 200 includes two mains plug pins 210, extending from an outer side of the plug unit, and a locking structure 240. The locking structure 240 includes a button, shown, for example, as a button 242 in FIG. 3. When the power supply is assembled, the locking structure interacts with the locking member 140 in such a way that pressing on the button will allow releasing the structure 240 and pushing the plug unit 200 from the engaging seat 120. The plug unit 200 has a flange 230, which is though an optional feature.

Also, the plug unit 200 includes contacts, which are to connect with the electric contacts 130, at the inner side of the plug unit 200. The plug unit 200 has safety recesses for its contacts at the inner side of the plug unit. As mentioned above, the inner side of the plug unit 200 is shown, for example, in FIG. 4.

In FIG. 1, the plug unit 200 is slidably connected with the engaging seat at side walls 122 and 123 of the engaging seat. However, in other embodiments the engaging seat may be formed, for example, without side walls, or may be formed with recesses in place of side walls. The slidable connection between the plug unit 200 and the engaging seat 120 may be formed, for example, with ribs on a plug unit housing and matching slots at the engaging seat 120.

Figure 2:
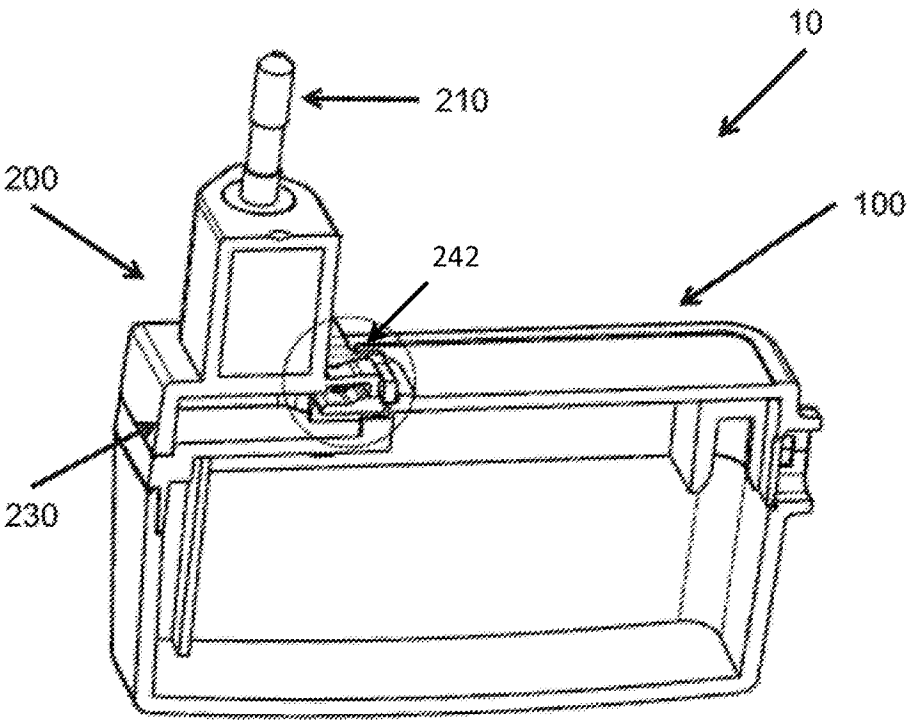
FIG. 2 shows a side view of a cross-section of the plug-in power supply according to FIG. 1, in the assembled state.

Referring to FIG. 2, it shows a perspective side view of a cross-section of the plug-in power supply 10, but in the assembled state. It is possible to push the button 242 down with a thumb or a finger, so as to release the locking between the locking structure 240 and the locking member 140, and then, when the locking structure 240 and the locking member 140 are disengaged, to make the plug unit slide to the left, with the same thumb or finger, by pressing onto the plug unit body and/or by relying on the friction between the thumb or finger and the button 242 while pressing on the button 242. It is convenient that no sliding of the finger or thumb, along the surface of the touch, is necessary, as it could be the case if the button was a part of the power adapter unit rather than plug unit.

Figure 3:
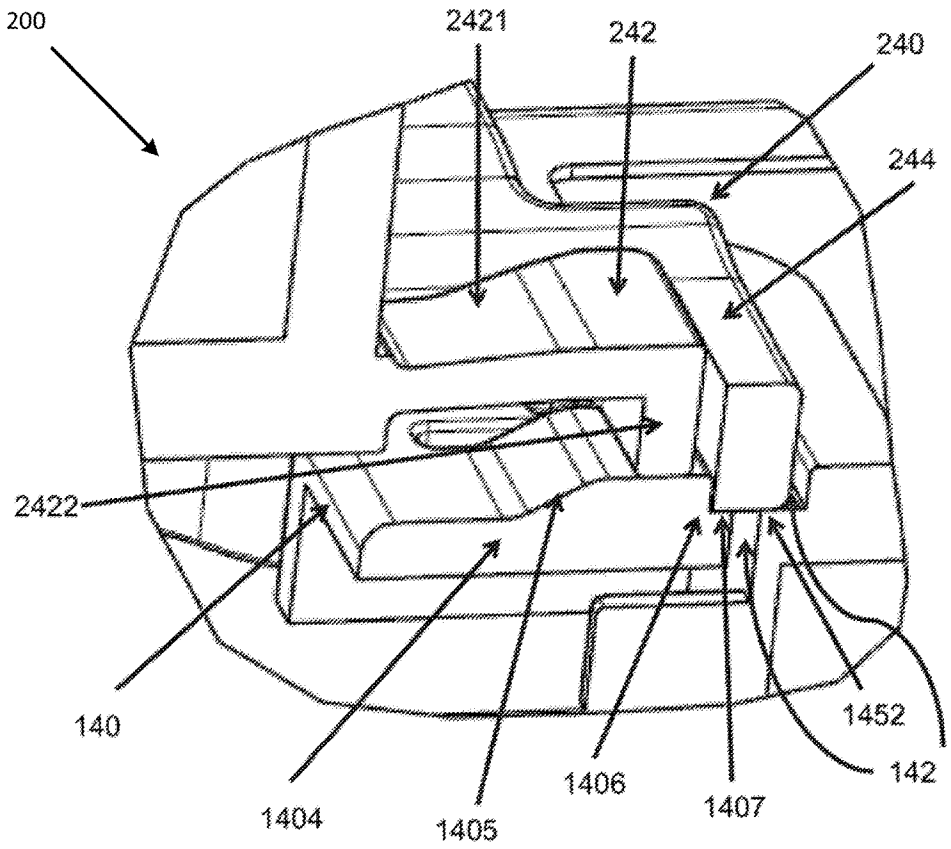
FIG. 3 shows a perspective blown-up view of a region of the cross-section shown in FIG. 2, with a locking between the plug unit and power adapter unit.

Referring to FIG. 3, it shows a perspective blown-up view of a region of the cross-section shown in FIG. 2, with the locking between the plug unit 200 and power adapter unit 100 in place. It shows one of a few of possible arrangements in which the locking structure includes a button and interacts with the locking member so that pressing on the button releases the structure and allows sliding of the plug unit from the engaging seat.

In FIG. 3, the locking member 140 has a half-rectangular frame 1401 a free tip 1404 protruding from this frame. A gap 142 is formed between this tip and the rear profile of the engaging seat. The tip 1404 is flexibly connected to the frame 1401. The locking structure 240 includes, besides the button 242, a snap 244. The snap 244 protrudes into the gap 142 and partially fills this gap when the power supply is in the assembled state. The button 242 is formed by a flange 2421 extending over the tip 1404. The flange 2421 is flexibly connected to the body of the plug unit 200, held in the sliding means.

Hence, pressing on the flange 2421 makes an angle between a plane of the flange 2421 and a plane of an upper surface of the snap 244 change. The tip 1404 of the locking member 140 moves down, and the gap 142 between the tip and the rear profile of the engaging seat moves with it. Eventually, it becomes possible for the snap 244 to move in the left direction in FIG. 3.

In FIG. 3 the rear profile of the engaging seat includes a step with a tread 1452. While in general this step with the tread is optional, the snap 244 conveniently rests on the tread 1452. In such an arrangement, the gap 142 between the tip 1404 and the profile of the engaging seat not only moves with the movement of the tip down, but it also takes a new shape.

Further, it is seen from FIG. 3 that the snap may have a form of a half-rectangular frame, as the snap 244 does. This form protects the button 242 when the plug unit is detached from the power adapter unit.

In FIG. 3 the flange 2421 extending over the locking member 140 has at an edge a flange 2422 extending towards the locking member. While the flange 2422 is optional, it may help to transfer the force of the push to the locking member 140 when the plug unit 200 is to be removed from the power supply.

Further, from FIG. 3 it is seen that the locking member 140 may be formed as a flange having a sliding bump 1405 for interaction with the button 242. When the plug unit is being pushed into the engaging seat, the button 242 moves from a bottom of the engaging seat, and the tip 1404 of the locking member 140 moves towards the bottom of the engaging seat. Hence, the bump 1405 makes it easier to install the plug unit in the power adapter unit.

In an alternative arrangement, the locking structure may be formed as a locking arm attached to the rear profile of the engaging seat with one end only. For example, the locking arm may be formed as a flange which has a shape of a hook in a plane of the sliding, in particular, a flange, which is twice curved for ninety degrees in the lateral plane. Such a shape makes it easier to push the tip of the locking arm into the engaging seat with one thumb or finger only.

In FIG. 3, the locking member 140 has a step 1406 with a tread 1407, at the tip 1404 forming the gap 142 between the tip and the rear profile of the engaging seat. This optional element helps to make the locking more stable, since the snap 244 rests on the tread 1407 and limits the movement of the button and the tip of the locking member.

Figure 4:
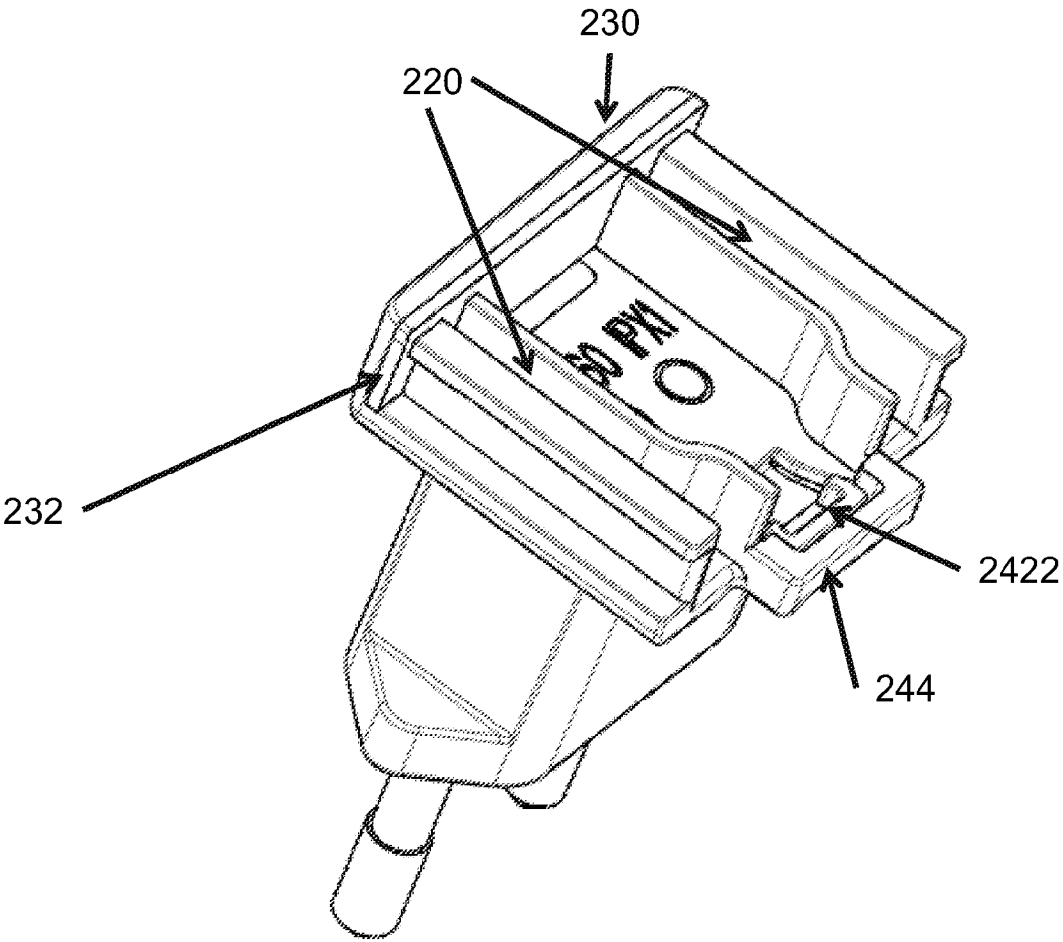
FIG. 4 shows a perspective view of an inner side of the plug unit as in FIG. 1.

Referring now to FIG. 4, it shows a perspective view of an inner side of the plug unit 200. The figure shows that the plug unit 200 has safety recesses 220 for its contacts, which are to connect with the electric contacts 130. It is preferred to make the safety recesses equal to, or deeper than, 5.5 mm and equal to, or narrower than, 2.4 mm.

As there may be a higher risk of water spillage if a person uses one hand only, it would be beneficial to additionally protect the power supply. For this purpose, the plug unit 200 is equipped with the flange 230, shown also in FIG. 1.

As seen in FIG. 1, the flange 230 matches a profile 105 at a respective, i.e. front, edge of the engaging seat 120. The flange 230 extends to cover gaps which are due to the sliding connection, i.e. a lateral gap between the plug unit 200 and a bottom of the engaging seat 120 and transverse gaps between the plug unit 200 and the side walls of the engaging seat 120.

Hence, the power supply may have a contact between the plug unit and the power adapter unit sealed against water ingress.

Furthermore, the plug unit may have a layer of a soft material attached to an inner side of the flange 230, as a layer 232 in FIG. 4. When the plug unit is installed into the power adapter unit, and the dimensions are such that the soft material is under pressure due to the locking between the plug unit and the power adapter unit, the contact between the plug unit and the power adapter unit may be even more waterproof.

Alternatively, in some arrangements, the soft and/or elastic material may be on the front profile of the engaging seat. This may help to keep the amount of the needed material lower. Also, the soft material may be attached to both the flange of the plug unit and its matching profile of the engaging seat.

In each of the examples, the slidable connection between the plug unit and the engaging seat in the power adapter unit may be arranged to start at an edge of the engaging seat, so as to make the connection longer, and thus tighter, against the water ingress. In other words, ribs and/or slots, with which the slidable connection may be arranged, may start at a front edge of the power adapted unit.

The power supply may be configured for usage with the United Kingdom mains socket. In this case the power adapter unit has one or more dielectric pin protruding from the engagement seat. These pins are to open a shutter in the plug unit when the plug unit has such a shutter and is slided into the engagement seat. The plug unit may have more than one shutter, for example, it may have a shutter for each electric contact.

In the example of FIG. 1, the power adapter unit 100 has two dielectric pins 132 and two dielectric pins 133. These pins are arranged in pairs for holding and protecting the contacts 130. Two front pins of these four pins may be stronger than the two rear pins, as they may be used for opening the shutter.

Figure 5:
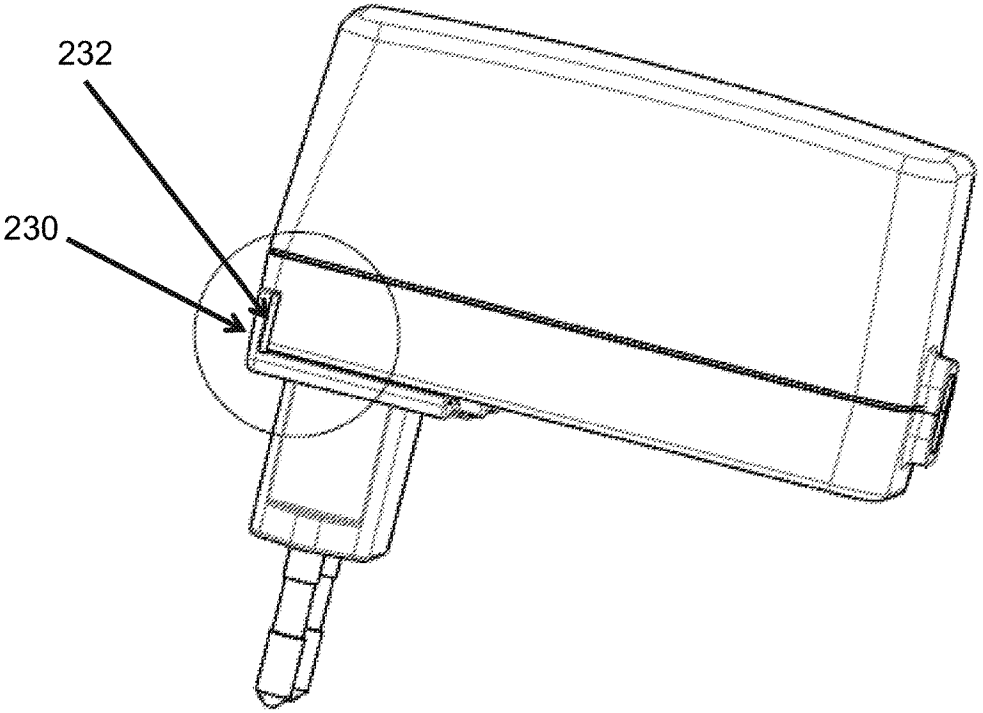
FIG. 5 shows a side view of a power supply protected from water ingress in the assembled state according to some embodiments of the invention.
Figure 6:
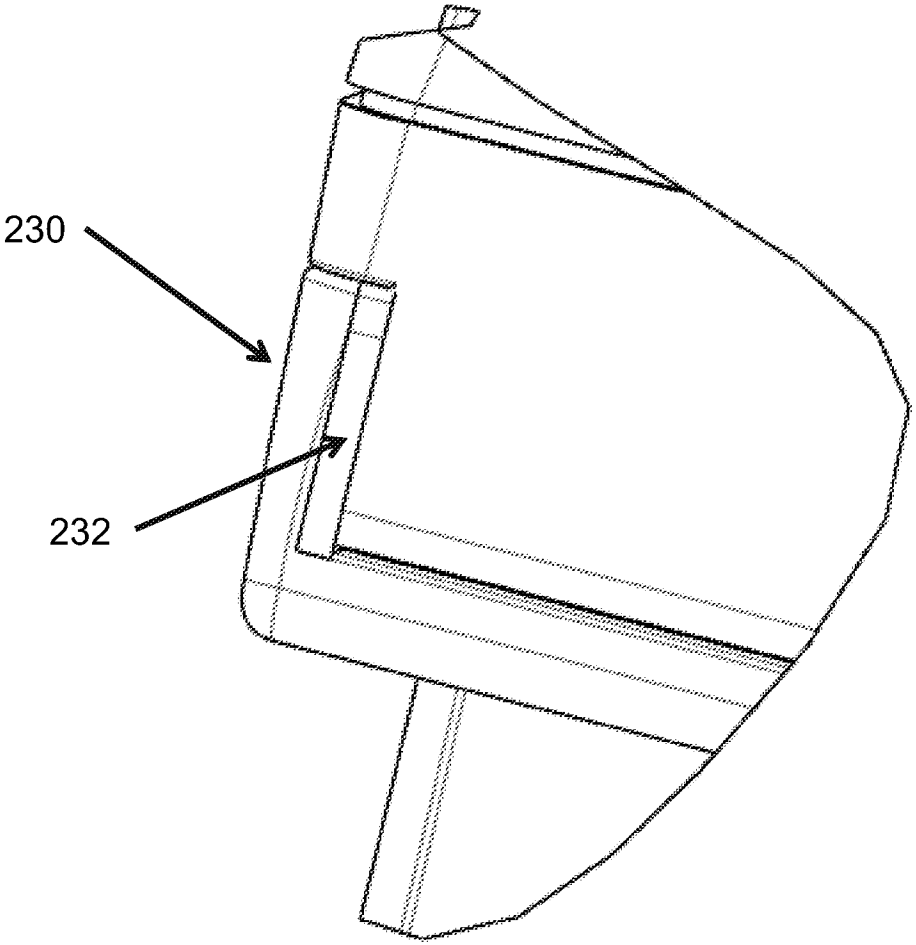
FIG. 6 shows a perspective view of a part of the power supply of FIG. 5.

Referring now to FIG. 5, it shows a side view of a power supply protected from water ingress according to some embodiments of the invention. FIG. 6 shows a perspective view of a part of the power supply of FIG. 5.

The water protective may be arranged as in any of the examples described above with reference to FIGS. 1-4, but arrangement of other parts, while possible, is not required to be the same.

Thus, some embodiments, with a focus on protection from water ingress, relate to a plug-in power supply for supplying a consumer with a low voltage, the power supply including a power adapter unit and an interchangeable detachable mains plug unit.

For example, the power adapter unit includes a housing, such as the housing 110 in FIG. 1; a voltage transformer module for converting a mains voltage into the required low voltage in the housing; an engaging seat, such as the engaging seat 120 in FIG. 1, for the plug unit, at an inner side of the power adapter unit to be directed towards a mains socket, the plug unit being slidably connected with the engaging seat; at least two electric contacts in the seat for connecting the transformer module with contacts at an inner side of the plug unit directed towards the power adapter unit. Furthermore, the power adapter unit includes a locking member at a rear profile of the engaging seat which limits the sliding of the plug unit.

The plug unit includes at least two mains plug pins, extending from an outer side of the plug unit and connected to the inner side contacts of the plug unit; safety recesses, for the contacts at the inner side of the plug unit; and a releasable locking structure interacting with the locking member, wherein releasing the structure allows sliding of the plug unit from the engaging seat.

Furthermore, the plug unit has a flange at an edge of the power supply device in contact with a matching profile at a respective edge of the seat, the flange extending to cover the sliding connection and a gap between the plug unit and the seat.

In the power supply, the contact may be sealed by a soft material attached to an inner side of the flange of the plug unit, the material being under pressure and thereby waterproof due to the locking between the plug unit and the power adapter unit.

In the power supply, at least one of an inner side of said flange and the matching profile at the respective edge of the seat may be covered with a material making said contact sufficiently tight to prevent a leakage of water into the engaging seat when the water is spilled on a respective side of the power supply.

The power supply may be waterproof according to standard IPX1, defined, for example, in a state of the patent or any other state of interest.

The slidable connection may start at an edge of the engaging seat in the power supply.

Figure 7A:
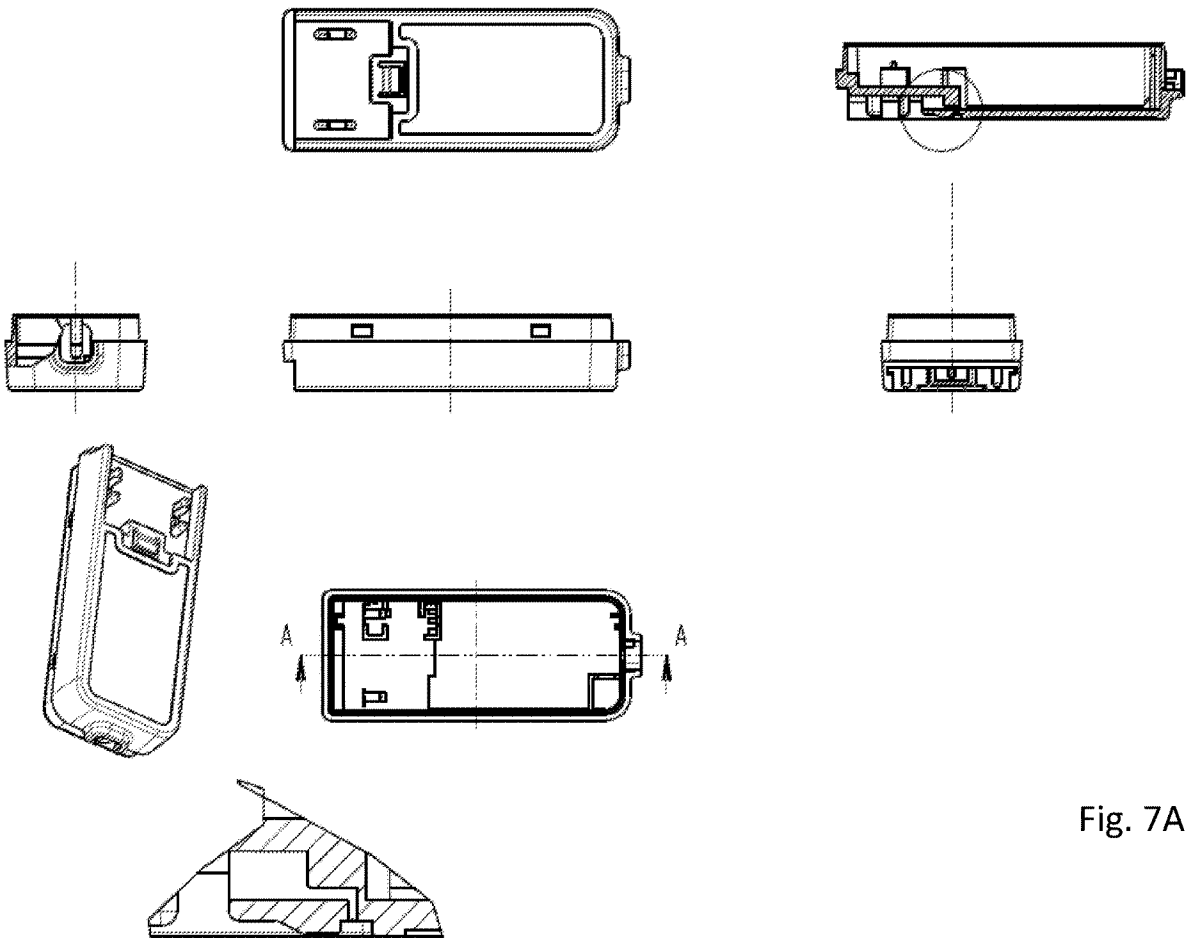
Figure 7B:
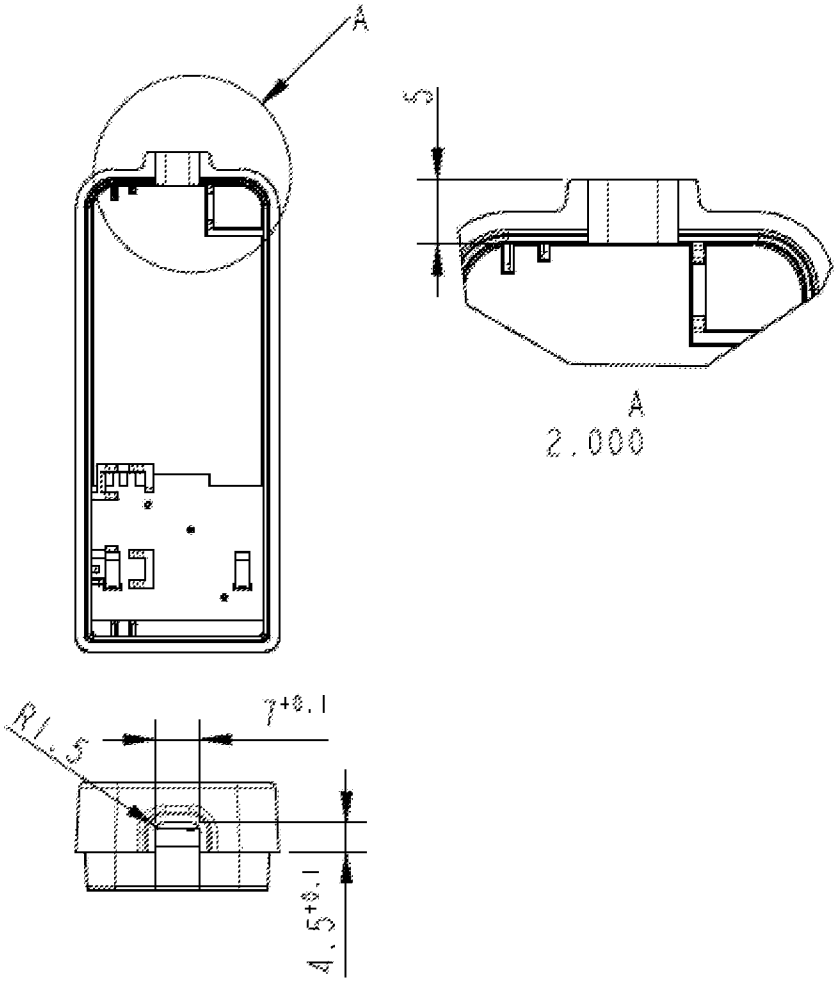
Figure 7C:
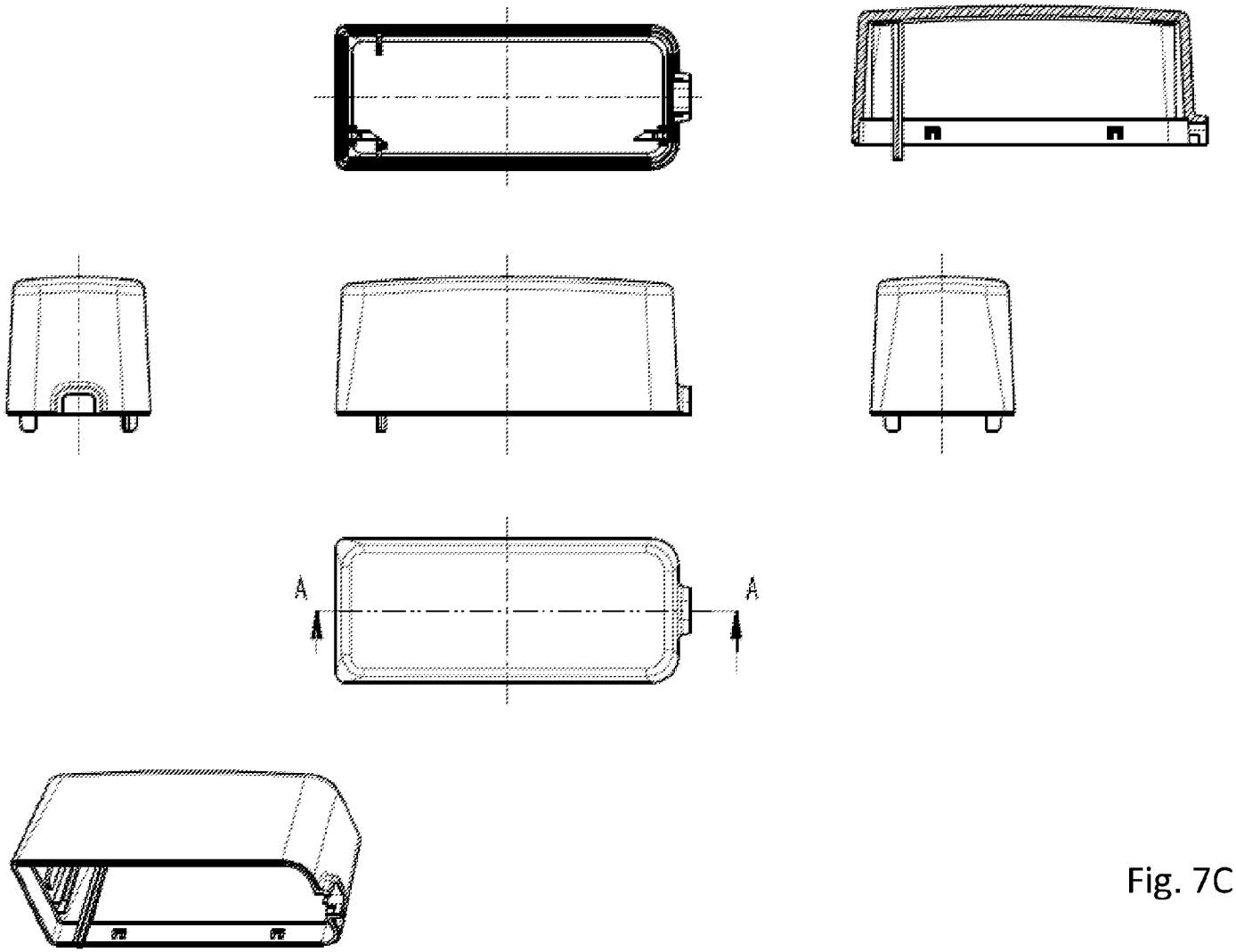
Figure 8:
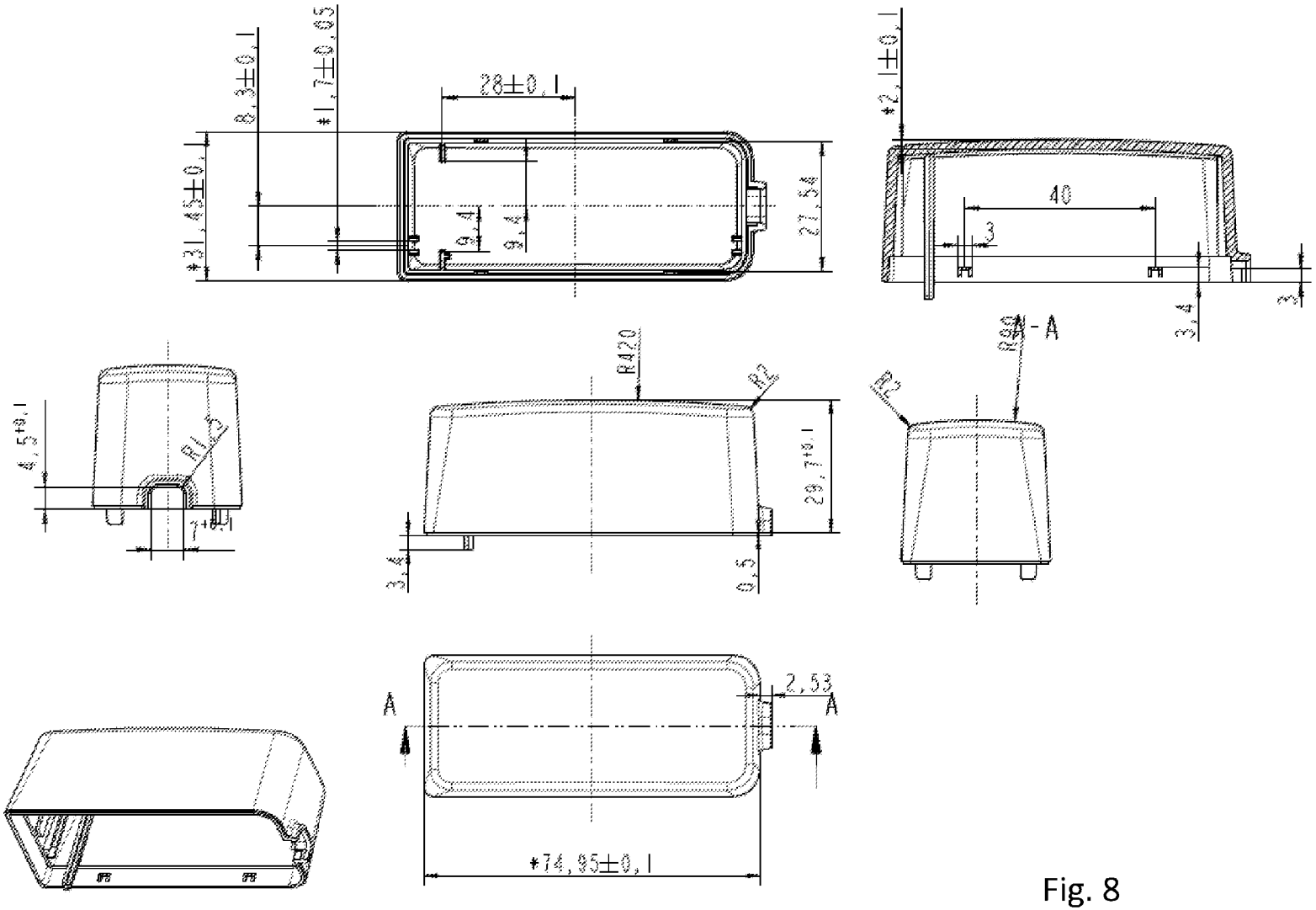

Referring to FIGS. 7A, 7B and 8, they are examples of engineering drawings for a housing of the power adapter unit. The housing is to be assembled from two parts: inner, or bottom, i.e. directed towards the power socket, shown by examples in FIGS. 7A and 7B, and outer, or top, shown in FIG. 8. The unit may provide a power of 12 W.

The engineering drawings are to be self-explanatory to the ordinarily skilled person in view of information in other parts of the present patent document.

Figure 9:
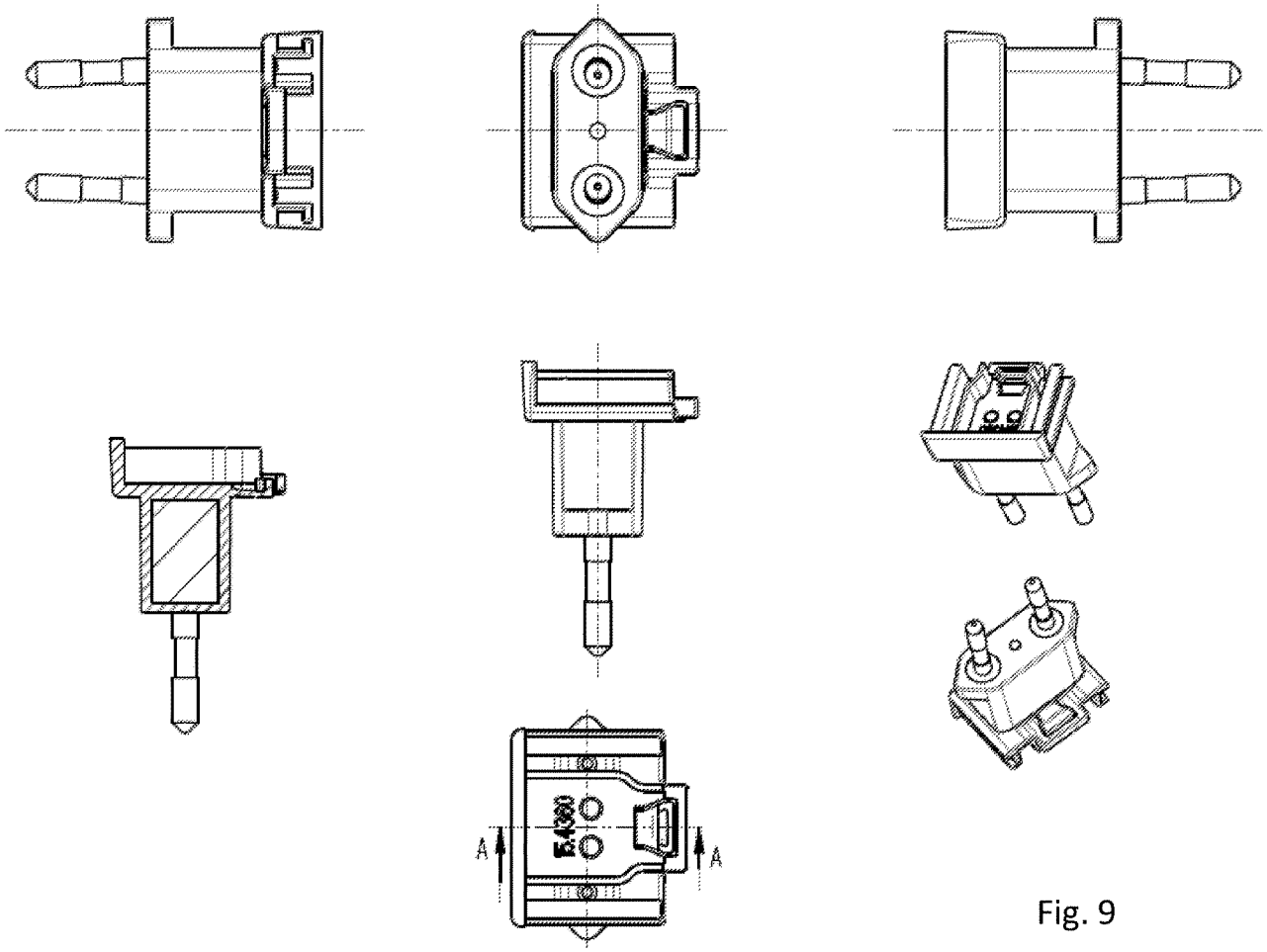

Referring to FIG. 9, it shows an example of an engineering drawing for a plug unit matching the Euro socket.

Figure 10A:
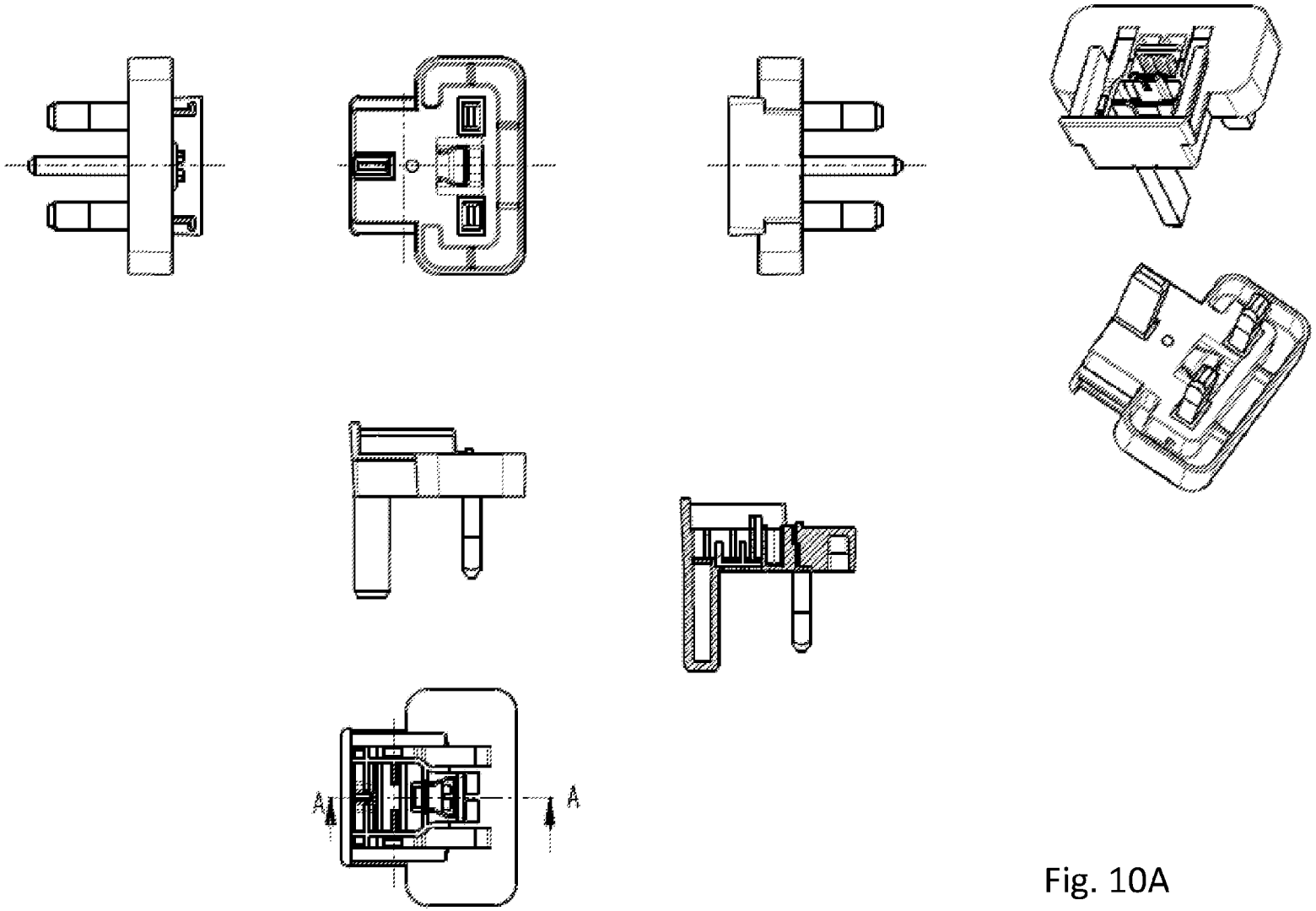
Figure 10B:
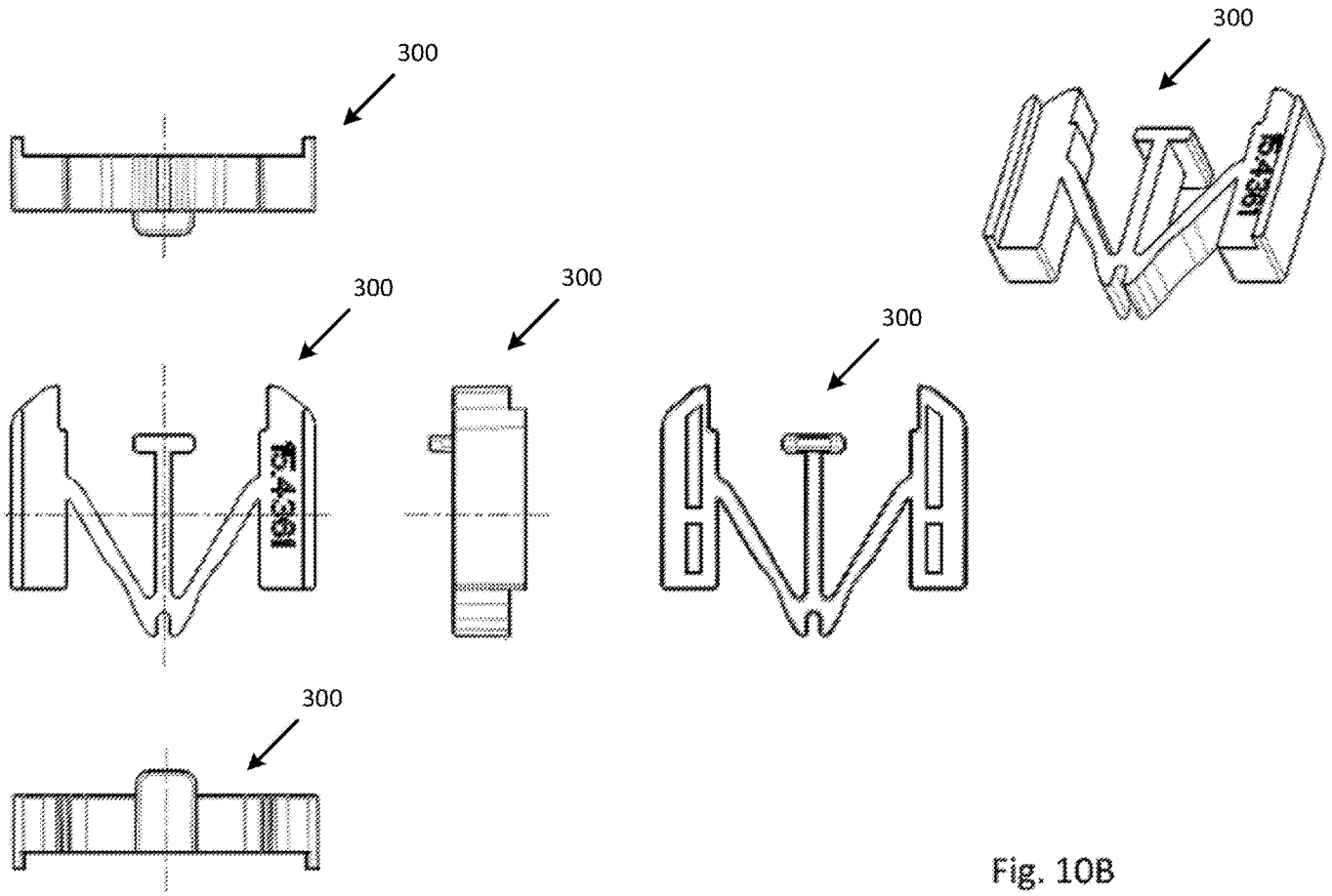
Figure 10C:
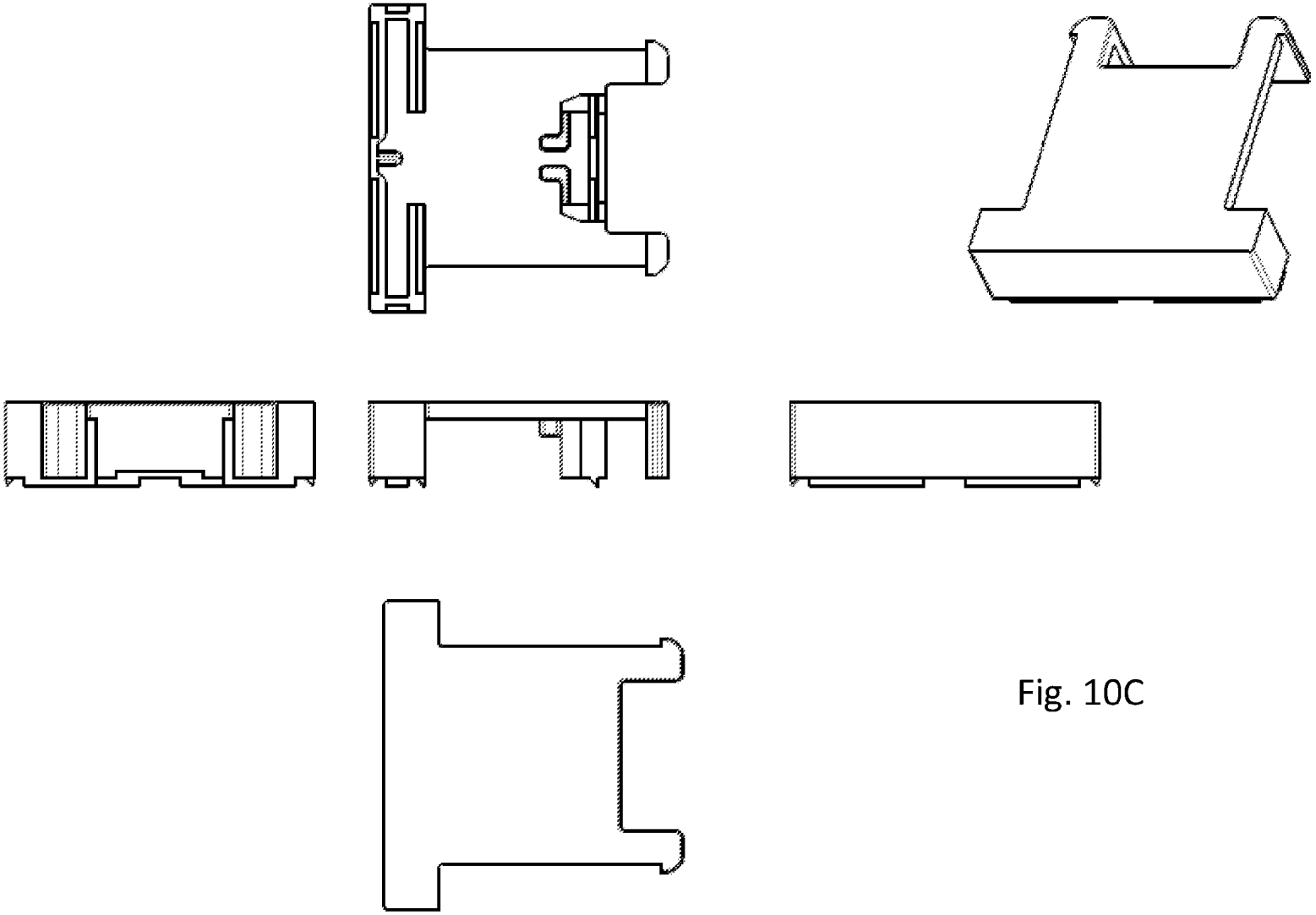

Referring to FIG. 10A, it shows an example of an engineering drawing for a plug unit matching the UK socket. The plug unit is to include a shutter 300, and FIG. 10B shows an example of an engineering drawing for it. FIG. 10C shows an example of an engineering drawing for a shutter over. FIG. 10D illustrates how the plug unit may be assembled with the shutter and the shutter cover of FIGS. 10B and 10C.

Figure 11:
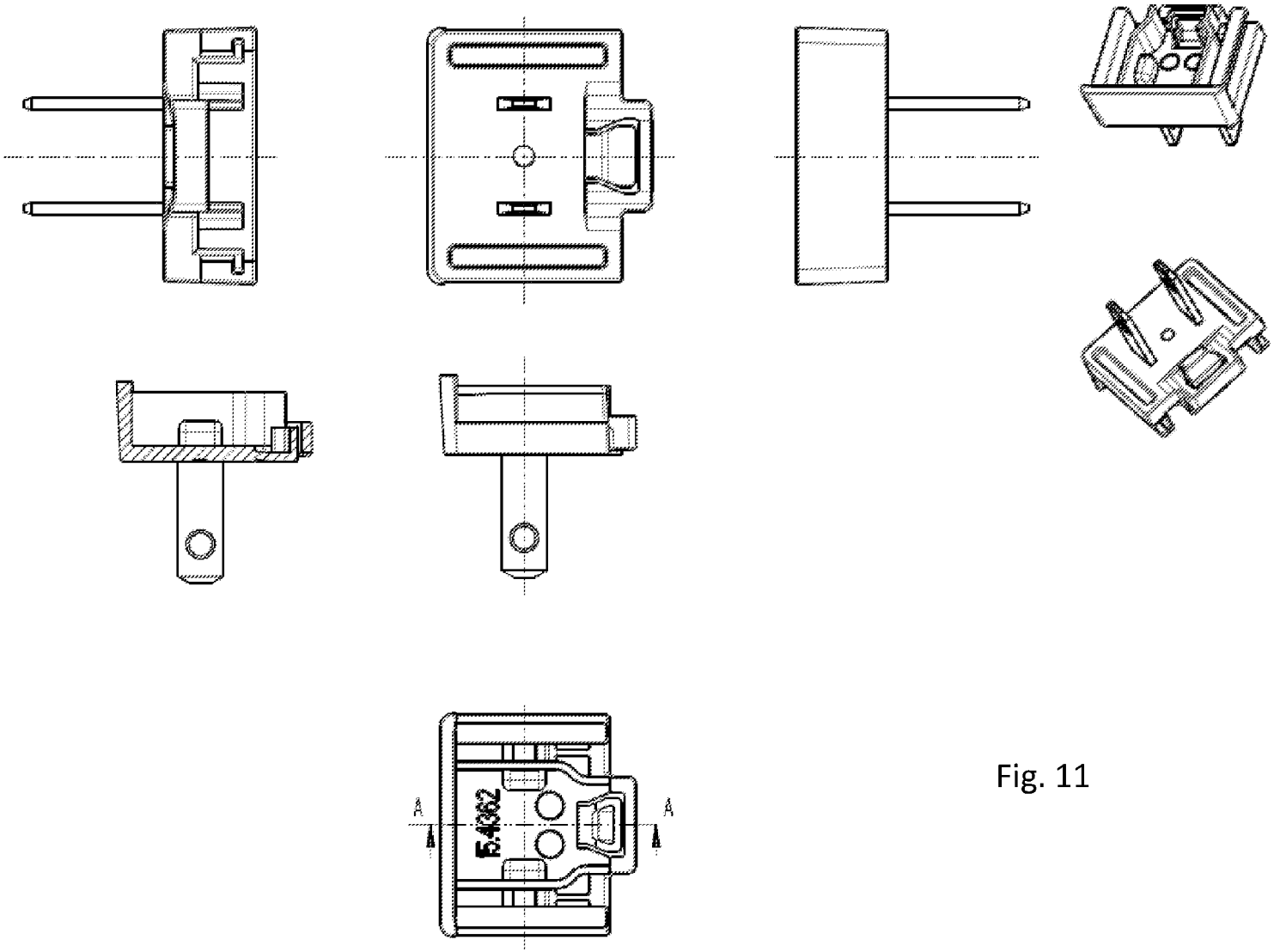

Referring to FIG. 11, it shows an example of an engineering drawing for a plug unit matching the USA socket.

Figure 12:
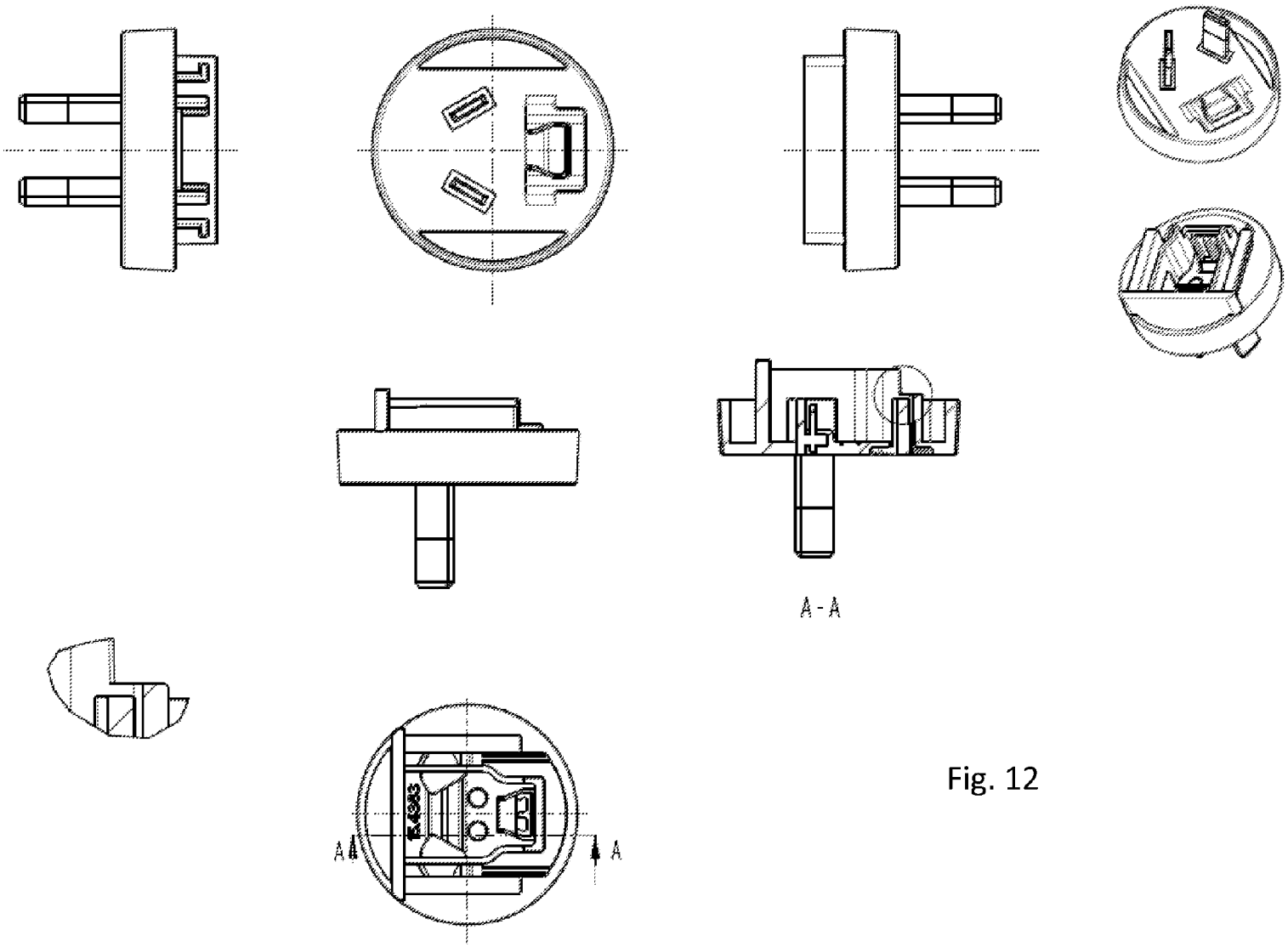

Referring to FIG. 12, it shows an example of an engineering drawing for a plug unit matching the Australian socket.

Various plug-in power supply sets for supplying a consumer with a low voltage from any of a plurality of types of mains sockets may be prepared. The set may include a power adapter unit and a plurality of interchangeable detachable mains plug units, so that an assembled power supply is to comprise said power adapter unit and one of the plurality of interchangeable detachable mains plug units.

Figure 13:
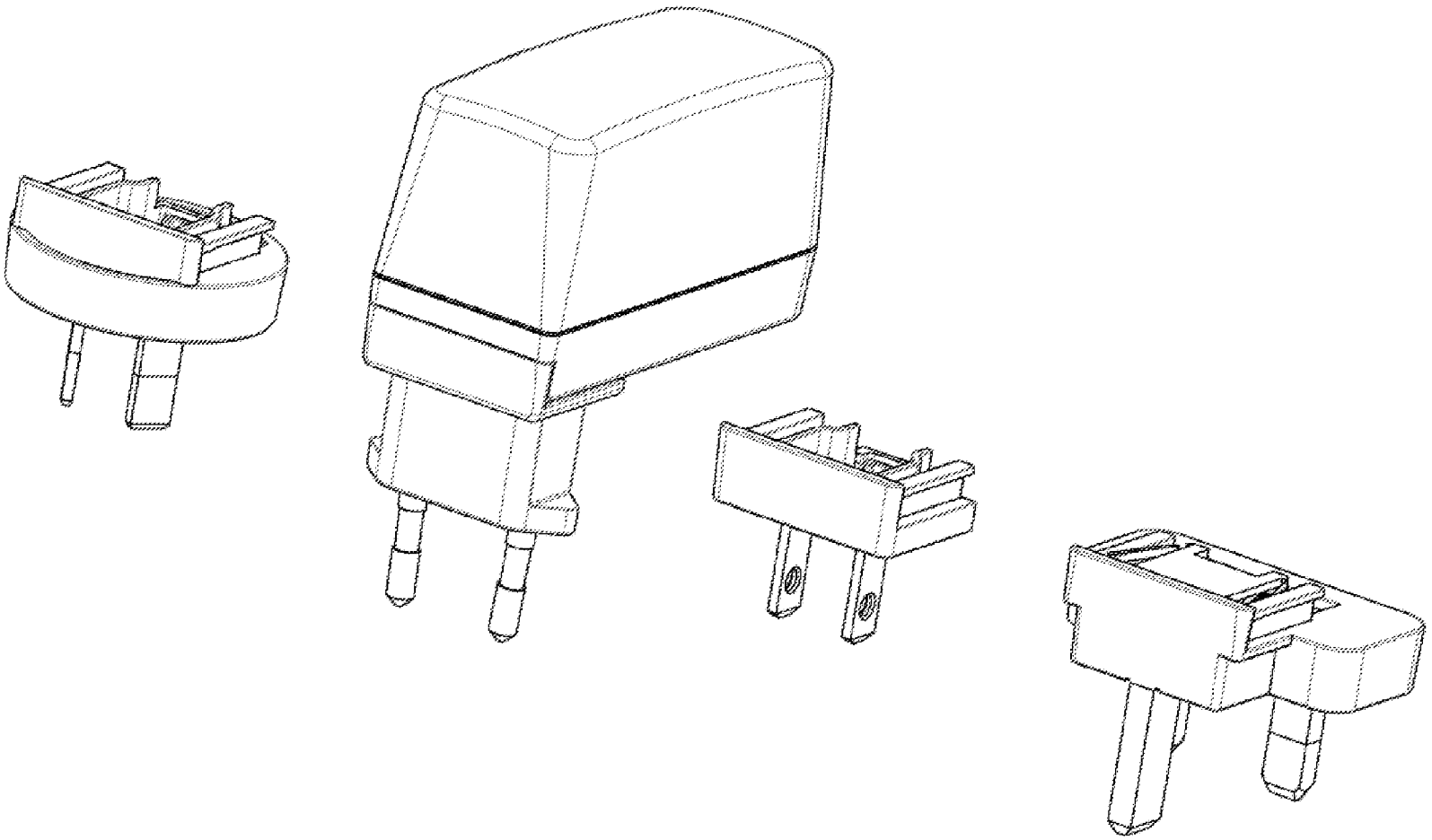

Referring to FIG. 13, it shows an example of a plug-in power supply set wherein the supply is to provide a power of 12 W.

Figure 14:
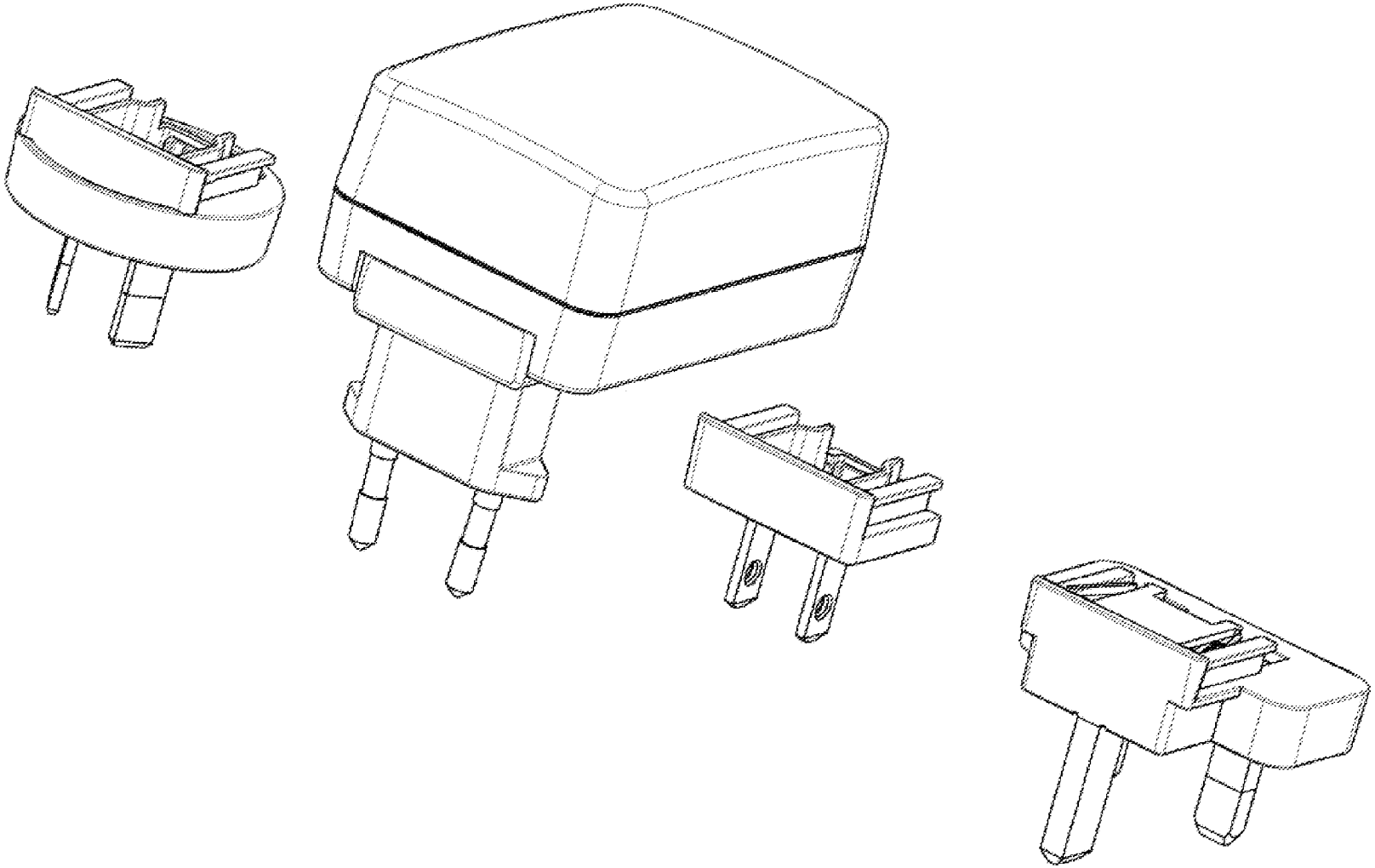
Figure 15A:
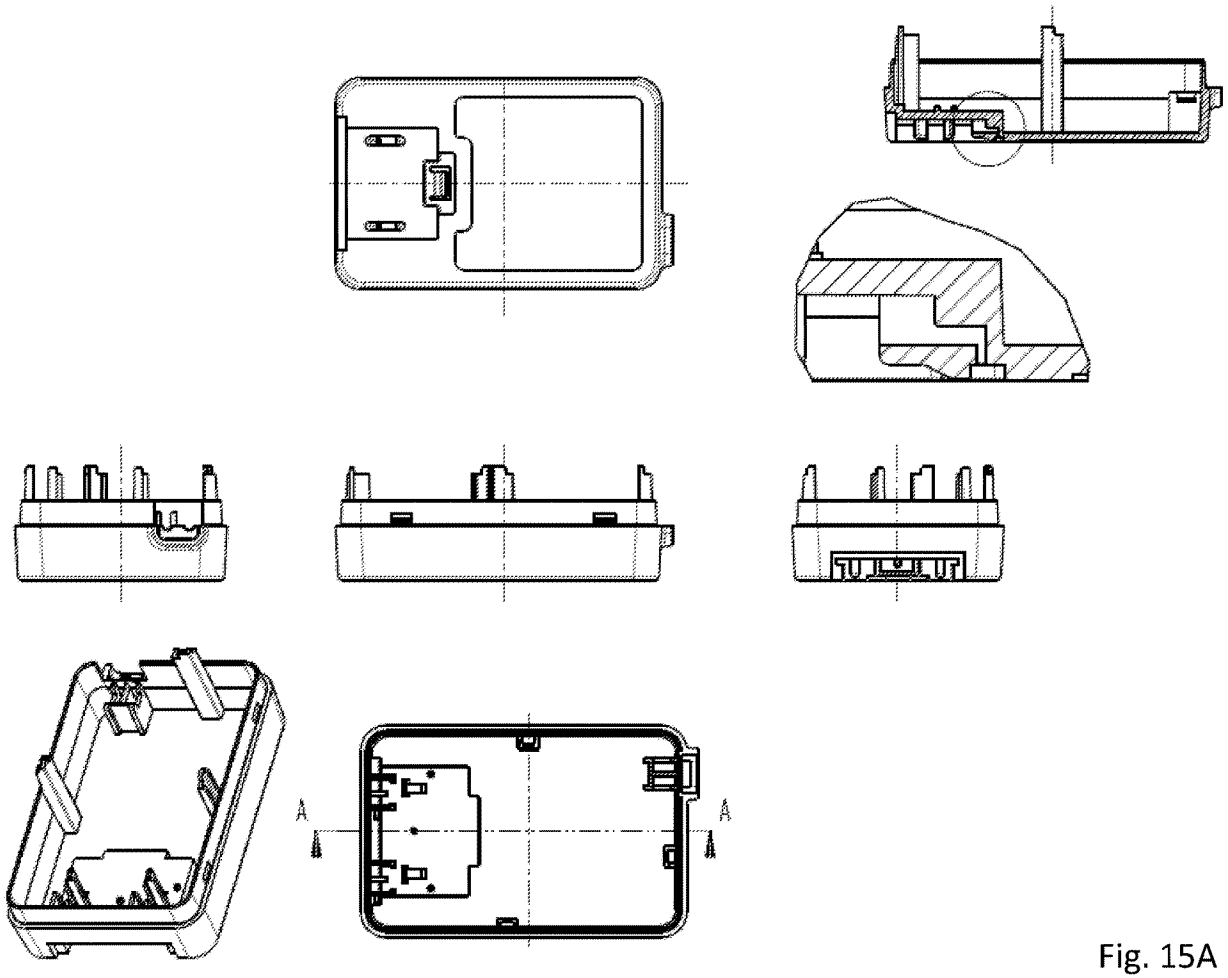
Figure 15B:
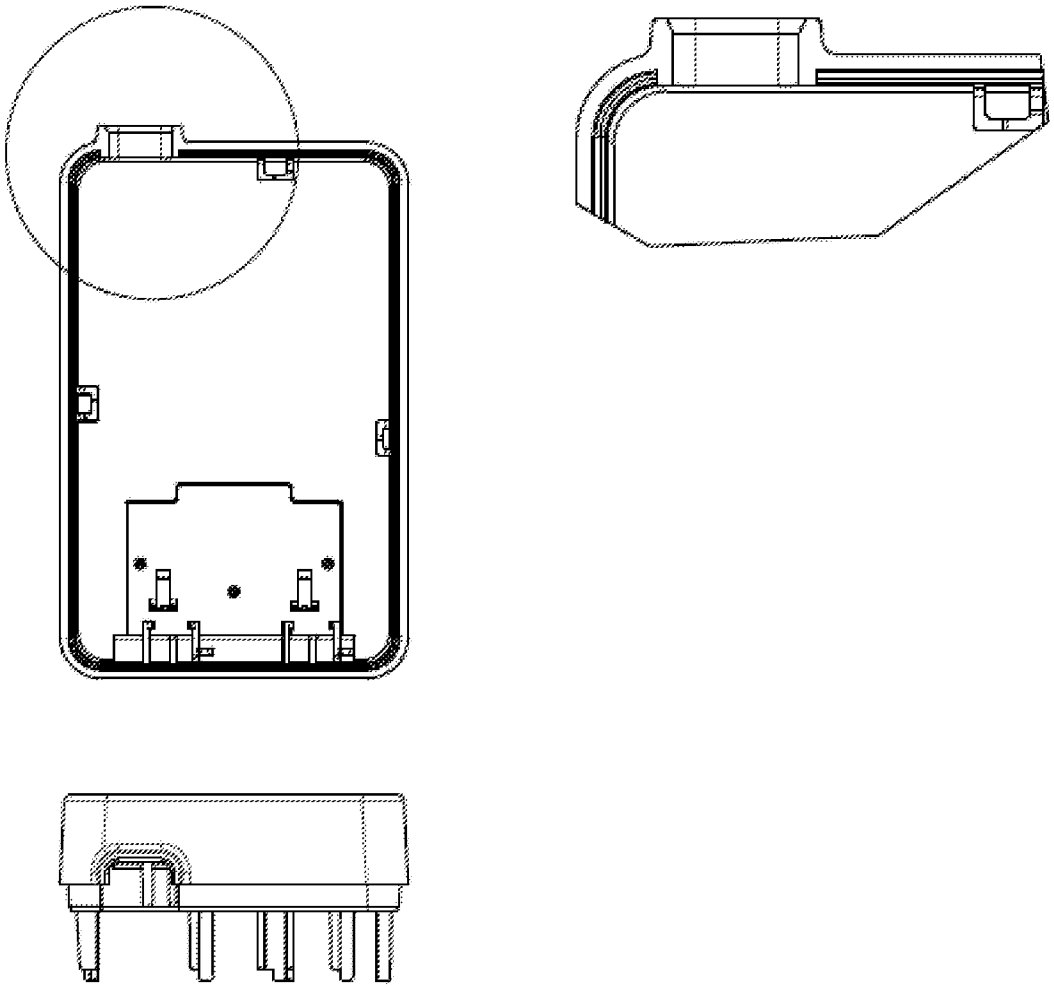
Figure 15C:
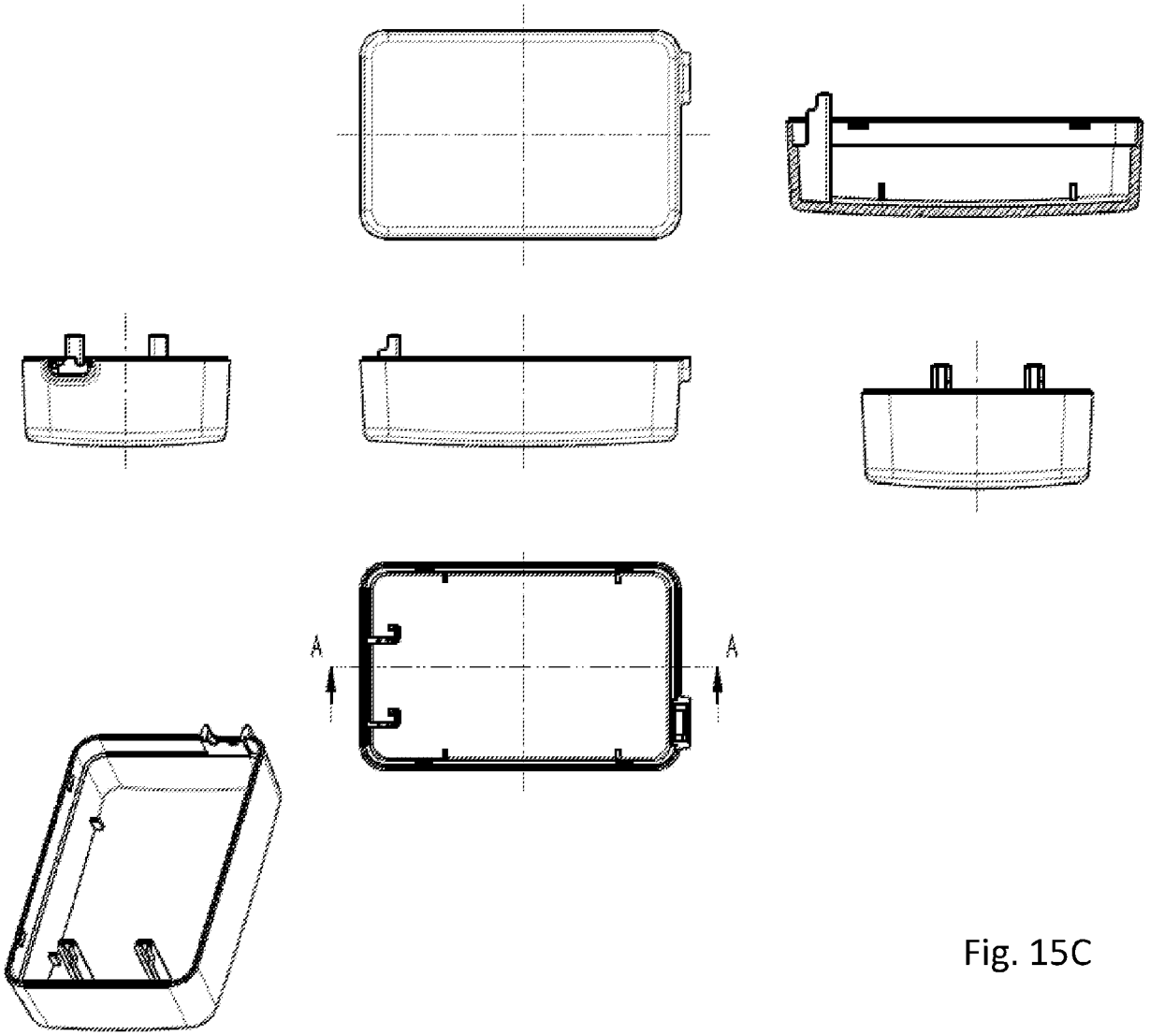
Figure 15D:
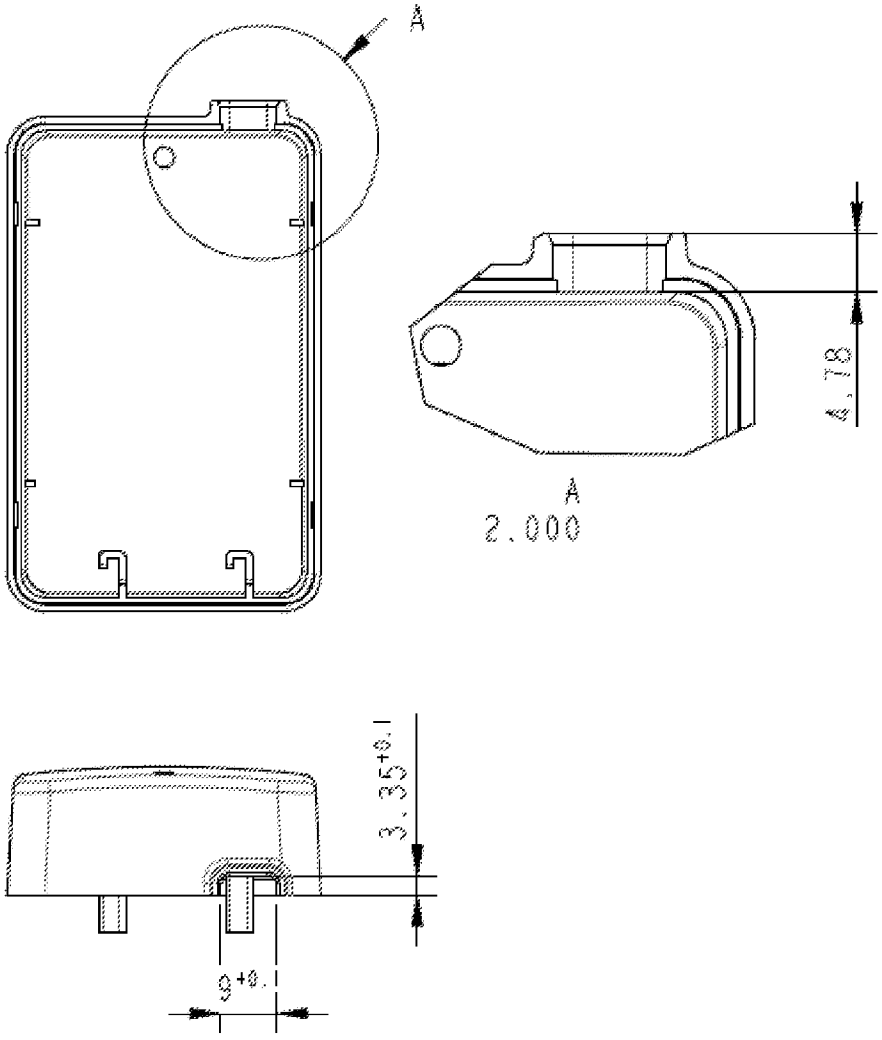

Referring to FIG. 14, it shows an example of a plug-in power supply set wherein the supply is to provide a power of 18 W.

Referring to FIGS. 15A, 15B, 15C and 15D they exemplify engineering drawings for a housing of the power adapter unit which may provide a power of 18 W. The housing is to be assembled from two parts. The inner part is shown by examples in FIGS. 15A and 15B, and the outer part is shown by examples in FIGS. 15C and 15D.

Figure 16A:
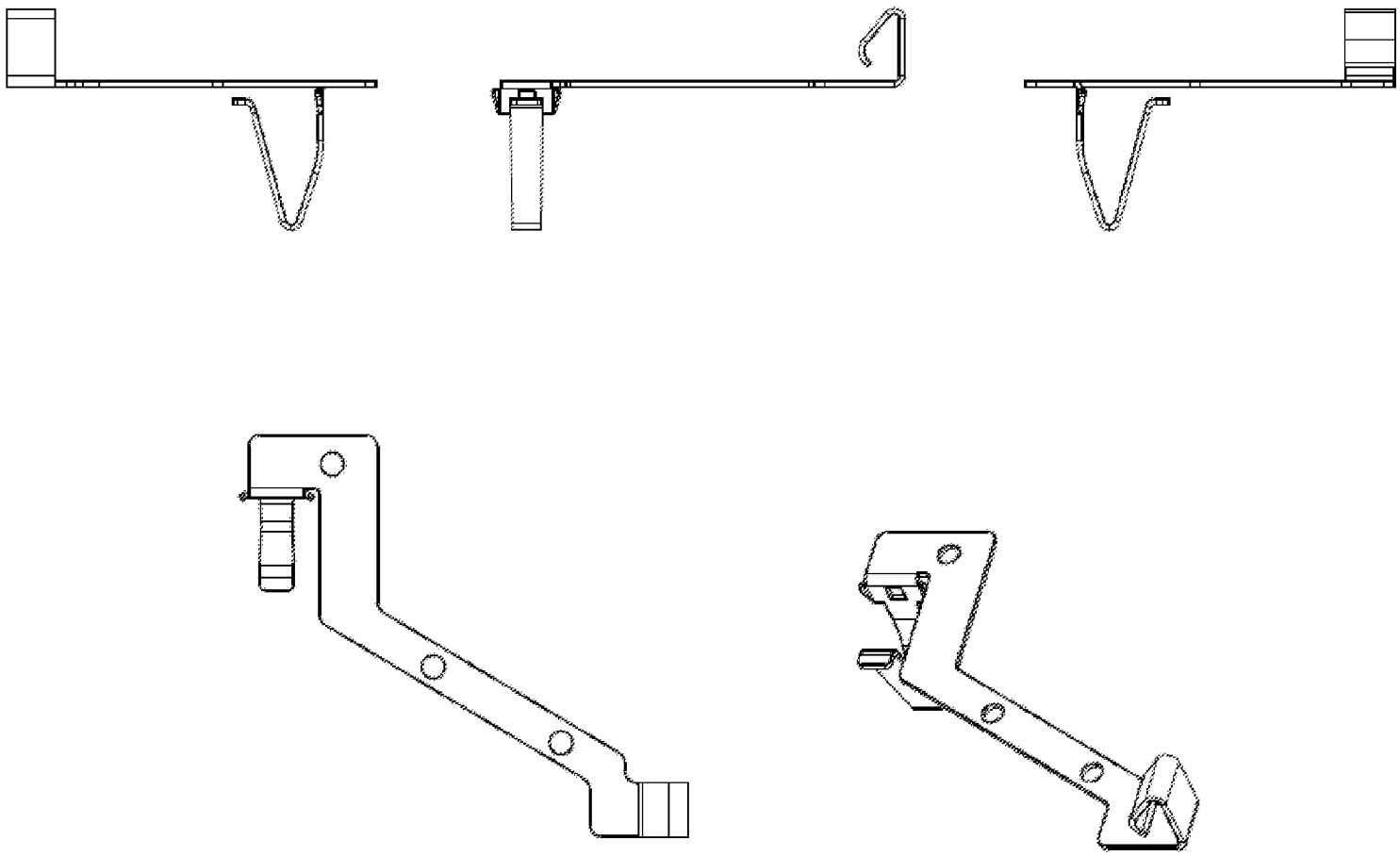
Figure 16B:
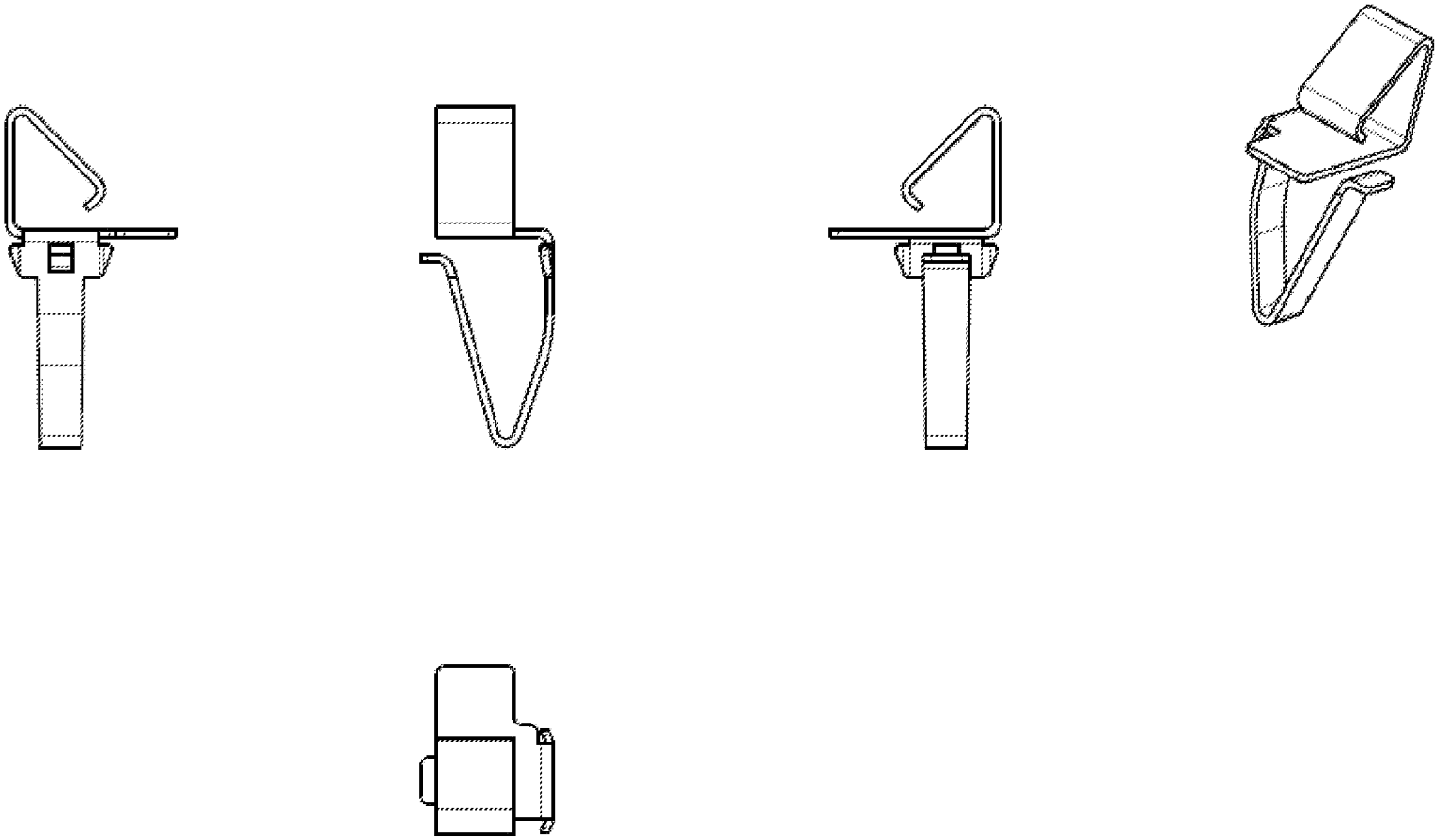
Figure 16C:
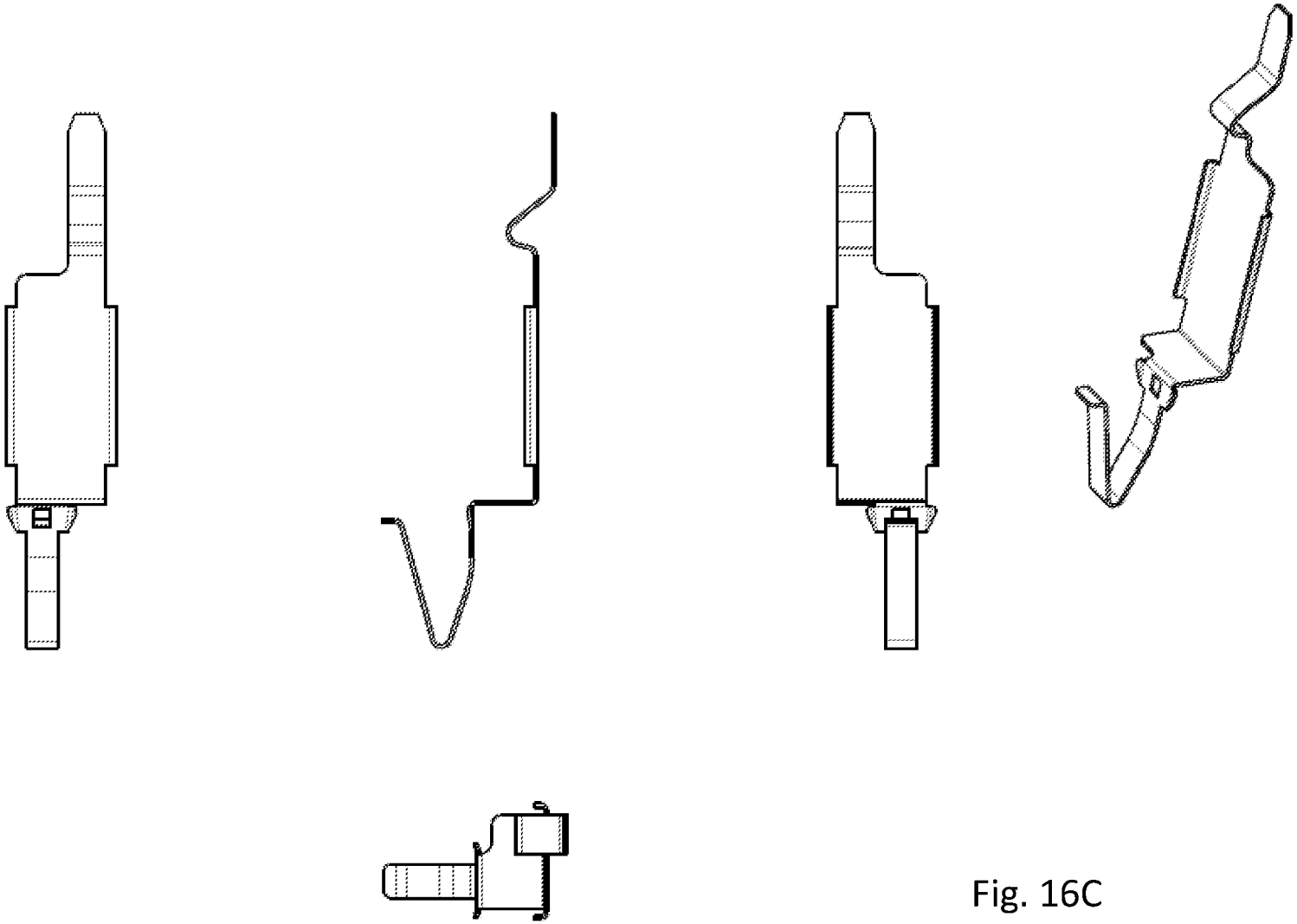
Figure 16D:
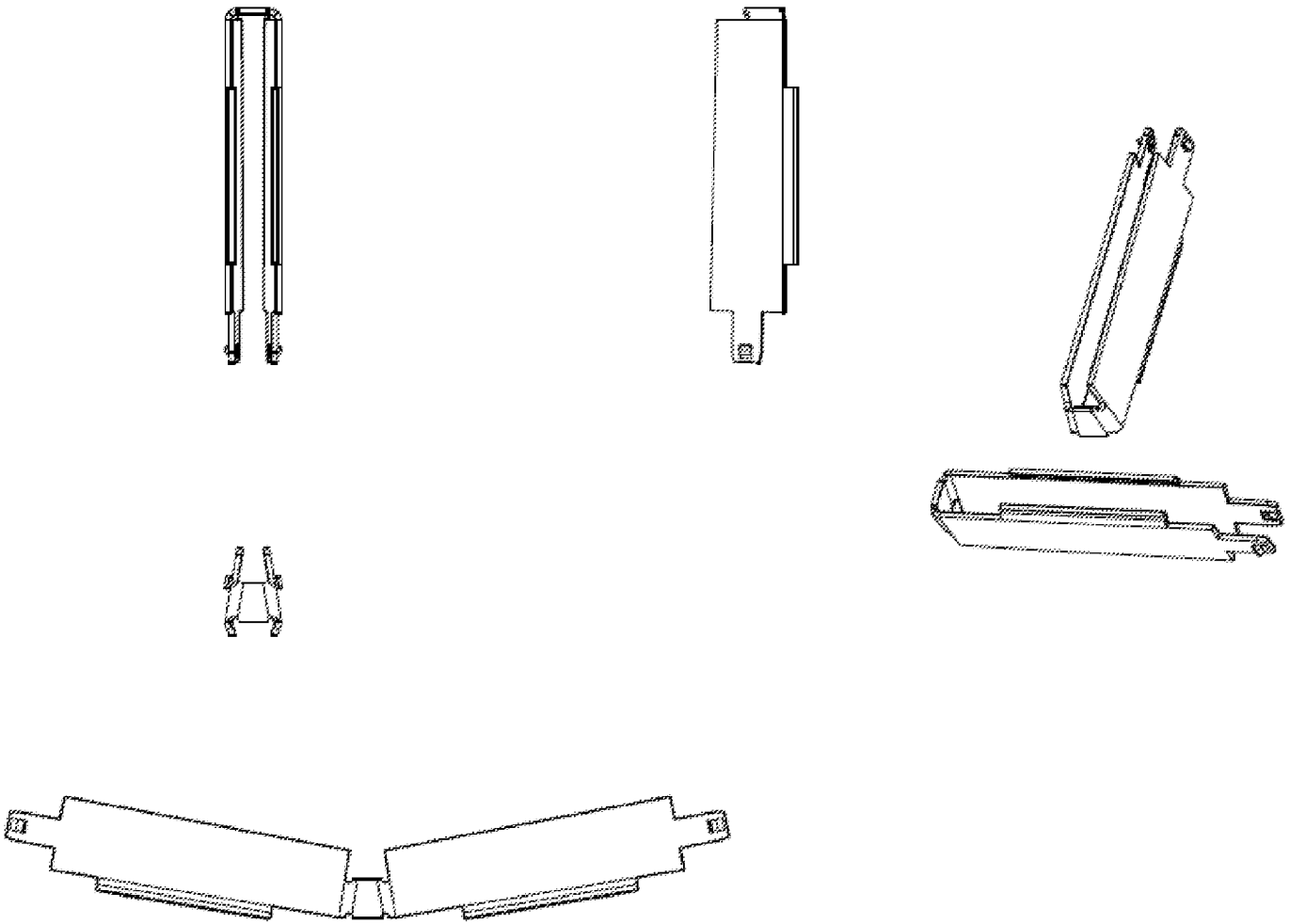

Referring to FIGS. 16A, 16B, 16C and 16D, they show examples of engineering drawings for the electrical contacts made as springs. FIGS. 16A and 16B relate to a left and a right contact, respectively, for the power adapter housing for the power of 12 W. A spring contact shown in FIG. 16C may be used with the power adapter housing for the power of 18 W. A spring contact shown in FIG. 16D may be used for a dc bias.

While the invention has been described with respect to the physical embodiments constructed in accordance therewith, it will be apparent to those skilled in the art that various modifications, variations and improvements of the present invention may be made in the light of the above teachings and within the purview of the appended claims without departing from the scope of the invention.

In addition, those areas in which it is believed that those ordinary skilled in the art are familiar have not been described herein in order to not unnecessarily obscure the invention described herein. Accordingly, it is to be understood that the invention is not to be limited by the specific illustrated embodiments, but only by the scope of the appended claims.

The invention claimed is:

1. A plug-in power supply for supplying a consumer device with a low voltage, the power supply comprising a power adapter unit and an interchangeable detachable mains plug unit, wherein:

the power adapter unit comprises a housing; a voltage transformer module for converting a mains voltage into the required low voltage in the housing; an engaging seat, for the plug unit, at an inner side of the power adapter unit to be directed towards a mains socket, the plug unit being slidably connected with the engaging seat; at least two electric contacts in the seat connecting the transformer module with contacts at an inner side of the plug unit directed towards the power adapter unit; and a locking member, at a rear profile of the engaging seat which limits the sliding of the plug unit, the plug unit comprises at least two mains plug pins, extending from an outer side of the plug unit and connected to the contacts at the inner side of the plug unit; safety recesses, for said contacts at the inner side of the plug unit; and a locking structure, comprising a button, for interacting with the locking member so that pressing on the button releases the structure and allows sliding of the plug unit from the engaging seat, wherein the plug unit has a flange at an edge of the power supply device in contact with a matching profile at a front edge of the seat, the flange extending to cover gaps between the plug unit and the seat, and wherein said contact is sealed by a soft material attached to an inner side of said flange of the plug unit, the material being under pressure and thereby waterproof due to the locking between the plug unit and the power adapter unit.

2. The power supply of claim 1 wherein the plug unit is slidably connected with the engaging seat at side walls of the engaging seat.

3. The power supply of any of claim 1, wherein the locking member comprises a frame and a tip flexibly connected to the frame and forming a gap between the tip and said rear profile.

4. The power supply of any of claim 1, wherein the locking member comprises a locking arm flexibly connected to the rear profile of the engaging seat and forming a gap between a tip of the arm and said rear profile.

5. The power supply of claim 3, wherein the locking structure comprises a snap protruding into said gap, and the button is formed by a flange extending above said tip.

6. The power supply of claim 5 wherein the flange extending over said tip has at an edge a flange extending to said tip.

7. The power supply of any of claim 3 wherein the locking member has a sliding bump.

8. The power supply of claim 3 wherein the locking member has a step at an edge forming the gap for the snap to rest upon a tread of the step.

9. The power supply of claim 1 wherein the at least two electric contacts in the seat are spring contacts.

10. The power supply of claim 1 wherein the plug unit has a flange at an edge of the power supply device in contact with a matching profile at a respective edge of the seat, the flange extending to cover gaps between the plug unit and the seat.

11. The power supply of claim 1 wherein said gaps are sealed against water ingress.

12. The power supply of claim 1 wherein at least one of an inner side of said flange and the matching profile at the respective edge of the seat is covered with a material making said contact sufficiently tight to prevent a leakage of water into the engaging seat when the water is spilled on a respective side of the power supply.

13. The power supply of claim 1 wherein the sliding connection starts at a front edge of the engaging seat.

14. The power supply of claim 1 wherein said safety recesses are equal to or deeper than 5.5 mm and equal to or narrower than 2.4 mm.

15. The power supply of claim 1 wherein one or more dielectric pins protrude from the engagement seat.

16. The power supply of claim 1 wherein the plug unit comprises one or more shutters for the electric contacts at the inner side of the plug unit and the adapter unit comprises one or more dielectric pins which hold the shutter open.

17. A cell phone package comprising a cell phone and the plug-in power supply according to claim 1, wherein said low voltage is a voltage required for charging the cell phone.

18. A tablet PC package comprising a tablet PC and the plug-in power supply according to claim 1, wherein said low voltage is a voltage required for charging the tablet PC.

19. A plug-in power supply set for supplying a consumer with a low voltage from any of plurality of types of mains sockets, the set comprising a power adapter unit and a plurality of interchangeable detachable mains plug units, so that an assembled power supply is to comprise said power adapter unit and one of the plurality of interchangeable detachable mains plug units, wherein:

the power adapter unit comprises a housing; a voltage transformer module, in the housing, for converting a mains voltage from any of said plurality of types of mains sockets into the required low voltage; an engaging seat, at an inner side of the power adapter unit to be directed towards a mains socket, for each of said plurality of plug units, wherein the one of the plurality of mains plug units is to be slidably connected with the engaging seat; at least two electric contacts in the seat connecting the transformer module with contacts at an inner side of said one plug unit to be directed towards the power adapter unit; and a locking member at a rear profile of the engaging seat which is to limit the sliding of said one plug unit, each plug unit comprises mains plug pins, for a certain type from the plurality of types of mains sockets, the mains plug pins extending from an outer side of the plug unit and connected to the contacts at the inner side of the plug unit; safety recesses, for said contacts at the inner side of the plug unit; and a locking structure, comprising a button, for interacting with the locking member of the power adapter unit so that pressing on the button when the power supply is assembled releases the structure and allows sliding of the plug unit from the engaging seat, wherein each plug unit has a flange at an edge of the power supply device in contact with a matching profile at a front edge of the seat, the flange extending to cover gaps between the plug unit and the seat, and wherein said contact is sealed by a soft material attached to an inner side of said flange of the plug unit, the material being under pressure and thereby waterproof due to the locking between the plug unit and the power adapter unit.

20. A plug-in power supply for supplying a consumer with a low voltage, the power supply comprising a power adapter unit and an interchangeable detachable mains plug unit, wherein:

the power adapter unit comprises a housing; a voltage transformer module for converting a mains voltage into the required low voltage in the housing; an engaging seat, for the plug unit, at an inner side of the power adapter unit to be directed towards a mains socket, the plug unit being slidably connected with the engaging seat; at least two electric contacts in the seat for connecting the transformer module with contacts at an inner side of the plug unit directed towards the power adapter unit; and a locking member at a rear profile of the engaging seat which limits the sliding of the plug unit, the plug unit comprises at least two mains plug pins, extending from an outer side of the plug unit and connected to the inner side contacts of the plug unit; safety recesses, for said contacts at the inner side of the plug unit; and a releasable locking structure interacting with the locking member, wherein releasing the structure allows sliding of the plug unit from the engaging seat, wherein the plug unit has a flange at an edge of the power supply device in contact with a matching profile at a front edge of the seat, the flange extending to cover gaps between the plug unit and the seat, wherein said contact is sealed by a soft material attached to an inner side of said flange of the plug unit, the material being under pressure and thereby waterproof due to the locking between the plug unit and the power adapter unit.

21. The power supply of claim 20 wherein at least one of an inner side of said flange and said matching profile at the front edge of the seat is covered with a material making said contact sufficiently tight to prevent a leakage of water into the engaging seat when the water is spilled on a respective side of the power supply according to standard IPX1.

22. The power supply of claim 20 wherein the sliding connection starts at the front edge of the engaging seat.

23. A plug-in power supply set for supplying a consumer with a low voltage from any of plurality of types of mains sockets, the set comprising a power adapter unit and a plurality of interchangeable detachable mains plug units, so that an assembled power supply is to comprise said power adapter unit and one of the plurality of interchangeable detachable mains plug units, wherein:

the power adapter unit comprises a housing; a voltage transformer module, in the housing, for converting a mains voltage from any of said plurality of types of mains sockets into the required low voltage; an engaging seat, at an inner side of the power adapter unit to be directed towards a mains socket, for each of said plurality of plug units, wherein the one of the plurality of mains plug units is to be slidably connected with the engaging seat; at least two electric contacts in the seat connecting the transformer module with contacts at an in-ner side of said one plug unit to be directed towards the power adapter unit; and a locking member at a rear profile of the engaging seat which is to limit the sliding of said one plug unit, each plug unit comprises mains plug pins, for a certain type from the plurality of types of mains sockets, the mains plug pins extending from an outer side of the plug unit and connected to the contacts at the inner side of the plug unit; safety recesses, for said contacts at the inner side of the plug unit; and a releasable locking structure and a locking structure interacting with the locking member, wherein releasing the structure allows sliding of the plug unit from the engaging seat, wherein each plug unit has a flange at an edge of the power supply device in contact with a matching profile at a respective edge of the seat, the flange extending to cover gaps between the plug unit and the seat, wherein said contact is sealed by a soft material attached to an inner side of said flange of the plug unit, the material being under pressure and thereby waterproof due to the locking between the plug unit and the power adapter unit.

* * * * *